US012715721B2

(12) United States Patent
Carboni et al.

(10) Patent No.: US 12,715,721 B2
(45) Date of Patent: Aug. 25, 2026

(54) MOVEMENT UNIT AND PROCESS FOR MOVING A BLANK AND PACKING APPARATUS ASSOCIATED THERETO

(71) Applicant: G.D S.P.A., Bologna (IT)

(72) Inventors: Salvatore Carboni, Bologna (IT); Antonio Vitali, Bologna (IT)

(73) Assignee: G.D S.P.A., Bologna (IT)

( * ) Notice: Subject to any disclaimer, the term of this patent is extended or adjusted under 35 U.S.C. 154(b) by 881 days.

(21) Appl. No.: 17/998,020

(22) PCT Filed: Jul. 5, 2021

(86) PCT No.: PCT/IB2021/055995

§ 371 (c)(1),
(2) Date: Nov. 4, 2022

(87) PCT Pub. No.: WO2022/009060

PCT Pub. Date: Jan. 13, 2022

(65) Prior Publication Data

US 2023/0183029 A1 Jun. 15, 2023

(30) Foreign Application Priority Data

Jul. 9, 2020 (IT) ..... 102020000016705

(51) Int. Cl.
*B65H 3/00* (2006.01)
*B65H 3/08* (2006.01)
(Continued)

(52) U.S. Cl.
CPC ..... *B65H 3/0883* (2013.01); *B65H 3/42* (2013.01); *B65H 5/12* (2013.01); *B65H 5/14* (2013.01);
(Continued)

(58) Field of Classification Search
None
See application file for complete search history.

(56) References Cited

U.S. PATENT DOCUMENTS 6,325,201 B1 12/2001 Bailey et al.
6,837,664 B2 1/2005 Blakesley et al.
(Continued)

FOREIGN PATENT DOCUMENTS

DE 10214381 A1 * 10/2003 ..... B65H 3/0875
EP 2253569 A2 * 11/2010 ..... B65H 31/3045
(Continued)

OTHER PUBLICATIONS

International Search Report and Written Opinion for International PCT Application No. PCT/IB2021/055995 filed on Jul. 5, 2021, on behalf of G.D S.P.A. Mail Date: Oct. 5, 2021. 11 Pages.

*Primary Examiner* — Steven M Marsh
(74) *Attorney, Agent, or Firm* — Steinfl + Bruno LLP

(57) ABSTRACT

A movement unit for moving a blank includes a drum, a blank with central and lateral panels, and a retention device for retaining the blank. The lateral panel has an end secured to the central panel by a folding zone and an opposite free end. The retention device is secured to the drum and includes a support, a first gripping portion secured to the support and having first retention elements configured to retain the central panel, and a second gripping portion secured to the support or to the first gripping portion and having second retention elements configured to retain the lateral panel.

18 Claims, 13 Drawing Sheets

(51) Int. Cl.
*B65H 3/42* (2006.01)
*B65H 5/12* (2006.01)
*B65H 5/14* (2006.01)

(52) U.S. Cl.
CPC .... *B65H 2402/30* (2013.01); *B65H 2406/343* (2013.01); *B65H 2406/3452* (2013.01); *B65H 2701/1764* (2013.01)

(56) References Cited

U.S. PATENT DOCUMENTS

| | | | | |
|---|---|---|---|---|
| 2004/0244864 | A1* | 12/2004 | Forche | B65H 5/14 139/391 |
| 2008/0272537 | A1* | 11/2008 | Sagesser | B65H 5/12 271/256 |
| 2012/0069114 | A1* | 3/2012 | Kaneko | B41J 13/223 271/18.1 |
| 2019/0283992 | A1* | 9/2019 | Maeyama | B65H 7/16 |
| 2024/0034579 | A1* | 2/2024 | Kalany | B65G 47/918 |

FOREIGN PATENT DOCUMENTS

| | | | | |
|---|---|---|---|---|
| FR | 3034404 | A1 | 10/2016 | |
| WO | WO-2020007942 | A1 * | 1/2020 | B65H 3/42 |

* cited by examiner

MOVEMENT UNIT AND PROCESS FOR MOVING A BLANK AND PACKING APPARATUS ASSOCIATED THERETO

CROSS REFERENCE TO RELATED APPLICATIONS

The present application is the US National Stage of International Patent Application No. PCT/IB2021/055995, filed on Jul. 5, 2021, which in turn, claims priority to Italian Application No. IT 102020000016705, filed on Jul. 9, 2020.

The present invention relates to a movement unit and process for moving a blank and packing apparatus associated thereto.

In particular, the retained and possibly moved blank is configured, in the embodiment described herein by way of example, to be used as containers for packing loose items.

The present invention finds a preferred, although not exclusive, application in the sector of packing loose articles in containers such as, for example, capsules of products by infusion, for example coffee, a sector to which reference can be made hereinafter without losing generality.

A movement unit generally comprises a retention device including devices suitable for securing some parts of the object of interest.

Typically, the containers pertaining to this technical field are produced by the packing apparatus starting from a semi-finished product of convenient shape according to the desired manufacturing processes and for which it is intended.

In a known process type, the semi-finished products used have four lateral surfaces which are secured to each other by folding creased portion to form a continuous lateral body closed on itself, as well as a bottom surface and an upper surface which are secured to said lateral body with possibility to rotate.

In this way, it is possible to shape the aforesaid semi-finished products from a substantially planar configuration, in which the lateral surfaces are located on two adjacent layers and two by two coplanar, to an open configuration, in which the adjacent lateral surfaces are substantially perpendicular to each other, by means of a simple rotation of one lateral surface with respect to another adjacent thereto.

However, this simple operation of controlled deformation of the semi-finished product during the manufacturing steps of a container actually requires a preliminary processing step.

This results from the fact that the semi-finished product is typically obtained from a blank.

The blanks generally used have a substantially planar shape in order to facilitate the transport and storage thereof in the warehouse and are configured in such a manner as to allow the desired container to be obtained, by folding and fixing or gluing the various panels that make up the flat blank. This blank is typically produced from cardboard or thin cardboard with folding lines, made by creased portion, which allow the container to be formed by folding operations folding the different portions of the blank and by fixing them to each other.

In this sense, therefore, the blank has an initial flat shape, takes on one or more spatial conformations of semi-finished blank during the various processing steps until it is completely formed into the desired final container.

Once the aforesaid container has been made, it is possible, again thanks to devices included in the packing apparatus, to fill this container with articles or products of interest.

In this context, a process for treating a blank is called "continuous" when at each time coordinate the conveyor that moves the blank has a speed other than zero. This speed considered is the speed of the conveyor during any processing step which leads to forming a container starting from said blank with respect to a fixed reference system and is intended as the speed of the conveyor in its entirety.

In this context, the term "container" identifies a structure shaped in such a manner as to be able to contain some material within it and in particular to be able to confine it at least laterally.

In context, the term "retention elements" identifies devices suitable for fixedly securing one or more portions of the blank or semi-finished product to them in such a manner that, during the retention step, at any movement of the retention element there is an equal movement of the aforesaid portion of the blank or semi-finished product retained.

In this context, a first element is defined as "engaged" with a second element when an interaction is established between the two elements such that the first element is able to determine the movement of the second element. This interaction may be, for example, of a mechanical, magnetic or other nature.

In this context, the term "fixedly secured" indicates a condition whereby there is a mutual engagement between a securing element and a secured element and that a translation movement in any direction of the former corresponds to an identical movement of the latter except for reduced movements that can be tolerated as a function of the characteristics of the blank and the processes used. A plane is said "horizontal" when it is parallel to the plane of the ground in which the forming unit object of the invention is installed.

Consistently, the term "vertical" identifies a direction perpendicular to the horizontal plane and so must be understood the terms relating to "upper" or "lower" positions that refer to an orientation in the vertical direction.

In this context, a "folding zone" identifies a region or portion of an element that presents a deformation facilitating portion or a region of privileged distortion. In this sense, examples of folding zones may be portions having a lower thickness than others, portions having specific arrangements of holes which are aligned or arranged in a specific desired pattern, creased portions, etc.

In this context, the term "disengaged" identifies a portion that is not secured by elements that are engaged thereon. In other words, a disengaged portion has the ability to move according to its own intrinsic characteristics.

The term "free" identifies a portion of an element that is not connected to other parts of the element and therefore includes an end part thereof. It is implicit to understand that this condition confers greater degrees of freedom of movement on that portion than on equivalent secured portions of the same element.

The term "interposed" is intended to identify the condition whereby a portion that is interposed between two lateral elements has its projection on a reference plane included between the projections on the same reference plane of the two lateral elements.

In this context, with the term "substantially parallel" it is considered an angular inclination angle between a first portion and a second portion which varies from 0° to +/−30°.

In this context, the term "pure rotation" means the rotation movement that is produced by a rigid body assuming that the rotation axis of this movement is fixed.

In other words, a movement of pure rotation is characterised in that, considering an operator of symmetry defined as a rotation axis A parallel to a vector Z of an orthogonal triad of vectors XYZ of a rigid body, this operator of symmetry moves all the points of the rigid body subjected to it by keeping them at a fixed spacing from the rotation axis A (this fixed spacing is defined as the "radius") and by modifying at each point of the circular trajectory, defined by the operator of symmetry for each point of the rigid body, the directions of the two vectors X and Y while keeping the direction of the vector Z constant.

In this same context, and for the sake of further clarity, the movement of pure translation is identified as a movement with respect to a reference point that leads to a change in the spacing of each point of the rigid body from the reference point while the directions of the three vectors XYZ do not vary.

It is therefore clear that the movement of pure rotation is different from a more complex movement such as, for example, roto-translation (which provides for the sum of at least one movement of pure rotation with at least one movement of pure translation) since not all the requirements of pure rotation are met.

In this context, by the term "virtual rotation axis" it is intended an axial operator of symmetry that does not coincide with a rotation axis of a corresponding rotating mechanical element, e.g. a pin, a shaft, a bearing, a hinge, etc. For convenience and further clarity's sake, axial symmetry operators that coincide with a rotation axis of a corresponding mechanical element will in this context be identified as "real rotation axes".

The terms "damaging", "damage" or "to damage" refer to the increase in the density of plastic component deformations (i.e. plastic and/or elastic-plastic deformations), and thus of the structural defects, in a surrounding of the material to be treated.

Such damages are considered excessive and therefore not acceptable when they compromise the processability and/or the use of the material according to its desired intended use. Cases of unacceptable damage mentioned purely by way of non-limiting example can be: impairment of the structural consistency of the material with excessive reduction or increase in the elastic modulus, formation of extensive surface or internal cracks, variations in surface roughness that make it difficult to have a good flat abutment surface to retain and move the material during the processing steps, anaesthetic variations in the surfaces to be exposed, etc.

This increase in the density of deformations with plastic component of the material is correlated to the relative movements of the various portions of the material being deformed and according to which the most appropriate surroundings are considered.

In this sense, a flexion of a material about one of its points leads to a compression zone and a traction zone in the cross section of the material, and therefore a limited increase in deformation density which is substantially contained at the rotation axis of the flexion itself. In this respect, a traction or a compression substantially entails a uniform variation of the whole cross-section, also in this case increasing the density of deformations. It is thus clear that a translation added to a rotation at one point induces more damages in the material than a simple rotation applied at the same point.

It should also be noted that possible undesirable deformations of the material change the spatial arrangement thereof, potentially compromising the following processing steps in an unpredictable way.

The Applicant has observed that the processes generally implemented by packing apparatuses that operate on semi-finished products provides for them being placed in a planar configuration on an initial hopper. The great advantage of using such a shaped semi-finished product therefore provides for obtaining the open configuration through very simple and rapid operations that are well suited to the industrial production need.

At the same time, however, the Applicant has ascertained that this method therefore requires a different initial forming apparatus, acting upstream of the packing apparatus using the semi-finished product, the forming apparatus which transforms the open planar blank into the semi-finished product with the desired closed lateral body.

The Applicant has also noted that these operations are generally carried out using different apparatuses as they involve complex and diverse retention, movement, folding and fixing systems that may be bulky or unnecessary in the following steps of forming the container.

In fact, the Applicant has ascertained that the blanks have various difficulties in being moved, due to their open planar development (thus void of closed structures that are secured on themselves) which can in some cases act as a "sail" with respect to the relative air flows produced during the aforesaid movements thus generating undesirable slowdowns or modifications of the programmed forming processes. (this phenomenon is indicated herein with the terms "sail effect", i.e. an effect of aerodynamic interaction between portions of the blank with the relative air flow brought about during possible movements).

The Applicant has also ascertained that in the prior art this type of aerodynamic problem represented by the sail effect is not even considered since the blanks are very often either large enough not to produce a significant sail effect when they are moved, or they are moved at low speeds that do not clearly show the latent presence of this effect and the possible dangers inherent in it.

Thanks to this awareness, the Applicant has observed that this sail effect remained latent, unknown and uncleared in the state of the art, in particular when the blank was moved flat.

It is important to note, therefore, that the widespread operational solution in this technology field aimed at the planar movement of blanks or even closed semi-finished products has accidentally produced the masking of this risky aerodynamic disturbance.

The Applicant has had confirmation of this accidental masking of the sail effect considering that normally this technological field opts to carry out the forming process of the container by means of devices which start this forming process from the semi-finished product having a closed lateral body which therefore presents considerably fewer movement difficulties than the open blank precisely due to its reduced degrees of freedom of movement during the displacements.

The Applicant has also pointed out that, as an alternative to the previous solution used in the prior art, the open blanks suitable for being able to produce at a certain level the aforementioned sail effect are traditionally moved by means of belts that keep them horizontal with respect to the laboratory plane, thus masking the latent aerodynamic problem.

The Applicant was therefore able to ascertain that this approach taught in the prior art derives mainly from a traditional and pre-existing implementation of the most immediate ways of moving the blanks and not from an existing awareness of the possible aerodynamic problem previously emphasised.

Going into these aspects in greater detail, the Applicant has also found that when using a blank having at least two panels that are interconnected by creasing (or similar type of constraint) and only one of said panels being fixedly secured to retention elements, a significantly problematic condition of sail effect on the non-retained panel can be brought about, which is correlated therefore to the aerodynamic interaction between the free panel and the relative air flow, which can even succeed in rotating around the creased portion, significantly modifying the shape thereof during the working steps. In other words, the Applicant has noted that this aerodynamic effect cannot be neglected in this case in order to carry out the desired working process in a safe, effective and well reproducible manner.

The Applicant has produced several experiments and simulations and found that this type of problem becomes increasingly critical as the movement speeds of the retention elements increase and the size of the blank increases.

Thanks to these analyses, the Applicant has noticed that under certain conditions this sail effect can even make the non-retained portion rotate through 180°, thus making practically unusable the retention devices, the movement devices and the folding devices arranged downstream of the station where this sail effect occurs.

The Applicant has proved that this effect reveals a dramatic problem not only during the working steps, but also during possible exchanging steps for exchanging the blank between different devices, entailing the possibility that entire portions of the blank to be retained are not in the envisaged positions and that the programmed shape of the blank is completely different from what is actually obtained.

The Applicant has therefore verified that such undesirable inconveniences may risk compromising not only the efficiency of the working process, but also the operational status of the various components involved.

Even more, the Applicant has found that this undesirable effect acquires a further critical value when the free and released portion of the blank is the one placed in advance with respect to the movement of the conveyor towards other portions of the blank.

In other words, thanks to targeted studies and in-depth studies, the Applicant has found that such sail effect has a more masked contribution if the non-retained portion is upstream of a retained portion according to a movement direction of the conveyor (i.e. as if the non-retained portion is a free and disengaged tail that easily adapts to the movements of the retained panel preceding it in the movement direction), while this sail effect has an extremely critical result if the non-retained portion is downstream of the retained portion according to the movement direction of the conveyor (i.e. as if the non-retained portion is the free and disengaged head and which is exposed to the maximum of the relative air flow incident on the blank thus undergoing strong stresses and consequent deformations).

Moreover, the Applicant has noted that even the orientation of the creased portion with respect to the direction of movement can lead to situations of different extent of uncontrolled deformation of the blank and of potential danger for the movement and working processes themselves.

In the technical context of the present invention, drums are also used as alternatives to belts or straps for moving the retained blanks.

Thanks to targeted analyses and simulations, the Applicant has noticed that this problem becomes even more critical and inevitable in the case where the blank is moved on circular trajectories in the case of a flat blank with an unretained panel which is free to rotate with dimensions such that it can incur a sail effect by interacting with the relative air flow produced during its movement.

As a result of this awareness, the Applicant has particularly noted that this aerodynamic problem related to the sail effect cannot be neglected in the case in which the blank is moved according to circular trajectories.

In fact, if in the case of horizontal movement on a belt of a flat blank with a free panel of such dimensions as to produce the sail effect, the relative flow of air below the blank and acting on it could be rather limited leaving the overlying flow component acting on the blank substantially uniform and constant, masking the sail effect and thus causing a contained and negligible apparent problem, in the case of movement according to circular trajectory on the drum this condition is no longer respected due to the continuous variation of the relative flow direction of the air with respect to the blank, thus bringing about a very critical, unreliable and dangerous working condition.

Furthermore, as a further problematic issue, the Applicant has noted that the use of the retention devices known in the state of the art when applied to the blanks tend to produce local deformations and damages on the blank due to internal compressions and/or tractions induced by the devices during the processing steps.

The Applicant has therefore perceived that it was advantageous to start the process of forming the container starting directly from the blank and that in order to do so it was necessary to develop a retention device of the blank that was able to meet the requirements even when there were components of rotary movement and therefore completely different from the prior art allowing a high adaptability to the particular features of the desired blank.

Thanks to this approach, the Applicant has verified that it is possible to manage the various movement steps during the forming more efficiently, since the division between the step of making the semi-finished product starting from a blank and the step of moving the semi-finished product to form the final container is waived, thus creating a single uninterrupted and joint movement and processing flow.

Furthermore, the Applicant has for the first time clearly identified the worst possible movement conditions for a blank with high deformability characteristics described above and has devoted considerable resources to overcome them.

Finally, the Applicant has found that the desired optimisation of the above-mentioned processes is achieved by realising a rotary movement unit comprising a retention device for retaining a blank which is shaped so as to have a tilting panel capable of producing a sail effect, said retention device comprising a first and a second gripping portion which are specifically provided with retention elements aimed at fixedly and simultaneously engaging both on the generally retained portion of the blank and on the free and released portion of the blank during the rotation movements.

In this way, it is possible to secure and control the portions of the blank that in certain situations could give rise to undesirable movements and/or deformations, guaranteeing the completion of the desired working process and at the same time minimising local deformations of the blank due to compressions or tractions thereof.

It is significant to note that the logic of the process is very different from that adopted in the prior art with regard to the concept of "controlled retention and movement": in fact, thanks to this invention it is overcome the condition according to which a process of forming is to be started by retaining a semi-finished product (previously formed from a blank), starting instead directly from a blank and at the same time managing to move it on a circular trajectory optimising its management and minimising the damage that can be caused as a result of the sail effect.

In particular, in a first aspect thereof, the invention relates to a movement unit for a blank comprising a drum which rotates about a rotation axis in a rotation direction.

Preferably, said blank comprises a first central panel.

Preferably, said blank comprise a lateral panel which is secured at a first end thereof to said central panel by means of a first folding zone and which has a second end which is opposite said first end and which is free.

Preferably, said lateral panel has an extent in a direction perpendicular to said first folding zone which is at least 10 cm. More preferably said lateral panel has an extent in a direction perpendicular to said first folding zone which is at least 20 cm and even more preferably is at least 30 cm.

This condition implies that the greater the extent of the lateral panel in the aforesaid direction perpendicular to the first folding zone, the more compelling is the need to control and reduce said sail effect acting on the blank.

Preferably, said lateral panel is arranged so as to be preceding in said rotation direction of said drum with respect to said central panel (i.e. said lateral panel is arranged downstream of said central panel in the rotation direction of said drum).

Preferably, said movement unit comprises a retention device for retaining said blank which retention device is secured to said drum and comprises a support.

Preferably, said retention device comprises a first gripping portion which is secured to said support.

Preferably, said first gripping portion comprises first retention elements which are configured to retain said central panel of said blank.

Preferably, said first retention elements are configured to selectively and fixedly retain said central panel of said blank.

Preferably, said retention device comprises a second gripping portion which is secured to said support or to said first gripping portion.

Preferably, said second gripping portion comprises second retention elements which are configured to selectively and fixedly retain said lateral panel of said blank.

In this context, this drum acts as a conveyor for said retention device and thus for said retained blank.

Thanks to this solution, it is possible to move the blank quickly by rotating the drum and effectively bringing the blank into the desired position.

What is more, thanks to this technical solution, it is possible to greatly reduce or even eliminate the sail effect acting on the free lateral panel of the blank, which could otherwise be significantly deformed, risking compromising the entire working process. In this way, it is possible to achieve a controlled rotation of the blank about the drum, optimising the specific positions and orientations of different portions as required.

Furthermore, this mode identifies an ideal solution if the retention device needs to remove the blank from a horizontally oriented hopper and then move it as far as a horizontal or vertical conveyor belt.

Horizontal hoppers are in fact practical and easy to use, as they allow the blanks to be treated to be loaded easily and efficiently in line, avoiding also the need to crush the blanks under their own weight, as happens with vertical hoppers.

The horizontal hoppers prepare the blank ready for the removal oriented according to a vertical plane. This orientation is not easy to use if the retention device of the blank is mounted on a conveyor belt since it would be necessary to make a belt that moves vertically and this operating mode is disadvantageous with respect to the force of gravity.

Furthermore, if the blank were to be released in a horizontal movement direction (very practical and advantageous for the forming processes), it would be necessary to rotate the advance direction of the conveyor belt through ninety degrees, which would take away useful space for any further components and make the path of the blank more complex and tortuous.

On the contrary, the solution realised according to the first aspect of the present invention allows to easily approach the blank retained by the horizontal hopper and to effectively remove it by moving it according to desire until releasing it to an additional retention device having for example a horizontal orientation. It is immediately clear that by rotating the drum it is possible to change the orientation of the blank in order to transfer it promptly to the desired additional retention device.

In a second aspect thereof, the invention relates to a packing apparatus for packing articles comprising at least one of said movement units for moving said blank made according to any one of the embodiments described according to any one aspect of the present invention.

Thanks to this solution, it is possible to realise an extensive packing line that benefits from the ideal system of moving and retaining blanks, avoiding the need to have an additional preliminary upstream plant for forming semi-finished products from blanks.

In a third aspect thereof, the invention relates to a process for moving a blank comprising the step of providing said movement unit comprising said drum having said rotation axis for rotating in said rotation direction and said retention device which is secured to said drum.

Preferably, the process comprises the step of providing said blank in which said blank comprises said central panel, a lateral panel which is secured at a first end thereof to said central panel by means of said first folding zone and which has a second end which is opposite said first end and which is free.

Preferably, the process comprises the step of providing said blank in which said lateral panel has an extent in a direction perpendicular to said first folding zone of at least 10 cm. More preferably said lateral panel has an extent in a direction perpendicular to said first folding zone which is at least 20 cm and even more preferably is at least 30 cm.

Preferably, the process comprises the step of providing said blank in which said lateral panel is preceding in said rotation direction of said drum with respect to said central panel (i.e., said lateral panel being downstream of said central panel in the rotation direction of said drum).

Preferably, the process comprises the step of bringing said drum into a removal position in which said retention device faces said blank.

Preferably, the process comprises the step of activating a first retention element of a first gripping portion of said retention device by selectively and fixedly securing said central panel to said first retention element.

Preferably, the process comprises the step of activating a second retention element of a second gripping portion of said retention device by selectively and fixedly securing said lateral panel to said second retention element, thereby bringing about a controlled configuration of said blank.

Preferably, the process comprises the step of rotating said drum in a rotation direction as far as a release position of said retention device, controlling by means of said first and second retention elements the respective positions and orientations of said central panel and said lateral panel.

Preferably, the process comprises the step of deactivating said retention elements by disengaging said blank from said movement unit while said drum is in said release position.

In this way it is possible to remove, move and release a blank and ideally manage its configuration and orientation in space while inducing small and limited material deformations. This is particularly true for the lateral panel, which can no longer be moved freely according to the sail effect brough about on it.

In at least one of the above-mentioned aspects, the present invention may also have at least one of the preferred features described below.

Preferably, said first and/or second retention elements are secured to said first and/or second gripping portion, respectively. Further preferably, said first and/or second retention elements are fixedly secured to said first and/or second gripping portion.

Preferably, said movement unit comprises a rotation unit which is configured to carry out a controlled rotation of at least one of said first gripping portion and second gripping portion of said retention device with respect to the radial direction of said drum.

Preferably, said controlled rotation of at least one selected between said first gripping portion and said second gripping portion of said retention device with respect to the radial direction of said drum is defined by an angle of inclination between 60° and 120°.

In this way, an ideal balance is achieved between the sail effect produced on the blank, the retention achievable on the latter and the overall steric dimensions of the movement unit and of the blank during the rotations and the desired processing steps.

More particularly, when a configuration is carried out whereby a portion of the blank is substantially oriented such that the angle of inclination is approximately 90°, the blank faces the relative flow of interacting air with its smallest possible area, thereby achieving the ideal aerodynamic arrangement during the rotation of the drum. This condition causes the blank to be subjected to a low value of the sail effect and therefore to be more easily controlled during the movement steps. Furthermore, considering, for example, a proximal arrangement of said first and second retention elements with respect to the blank, taking the rotation axis of the drum as reference, the condition whereby the angle of inclination is between 60° and 90° leads to a situation in which the sail effect produced on the blank during the rotation of the drum pushes the blank against the first and second retention elements, further increasing the effectiveness of the engagement and reducing the advance energy required and therefore the overall current consumption. This solution can be particularly interesting when it is wished, for example, to use a lower retention force and to benefit from the additional securing contribution that the sail effect brings about in this specific condition. Furthermore, this configuration means that the overall steric dimensions of the blank and retention device does not increase according to a radial component, which can simplify and facilitate the working during the rotation of the drum. Furthermore, considering, for example, the aforesaid proximal arrangement of said first and second retention elements with respect to the blank, taking the rotation axis of the drum as reference, the condition whereby the angle of inclination is between 90° and 120° leads to a situation in which the sail effect produced on the blank during the rotation of the drum pushes the blank away from the first and second retention elements, facilitating their detachment. This solution can be particularly interesting when, for example, it is wished to increase and make more effective the distancing of the blank from the retention device. Additionally, this configuration makes sure that the blank can be positioned in a fully coplanar configuration and therefore easier to remove for an additional gripping device once the drum has reached a desired release position. According to an embodiment, said rotation group may comprise a movement mechanism, which is configured to move said first gripping portion with respect to said second gripping portion of said blank, a cam type rotation mechanism, which is configured to produce a variation of angular speed, and thus also a relative variation of orientation, of said retention device with respect to said drum, a movement device which is configured to simultaneously move in translation said first gripping portion and said second gripping portion with respect to said support or with respect to another predetermined reference, an additional movement device of said movement unit which can be activated during rotation of said drum, or combinations thereof.

Thanks to this technical solution, it is possible to retain and move the second gripping portion with respect to the first gripping portion of the blank, so that the arrangement of one portion of the blank with respect to another can be controlled in a desired and ideal manner.

This aspect is particularly advantageous because in this case it becomes possible to manage the orientation of the portions of the blank that are secured to the retention device during the rotations of the drum. In particular, it becomes possible to selectively orient both portions with respect to the rotation direction of the drum and, therefore, with respect to the relative air flow interacting with the surfaces of the portions of the blank.

By rotating a portion so as to increase or reduce the angle defined between the portion and the radial direction of the drum, it is possible to simultaneously determine the desired sail effect produced on the surfaces of the blank, balancing it with the force exerted by the retention elements and with the overall steric dimensions produced during the rotation on the drum by the various portions of the blank that are selectively oriented.

This technical solution thus identifies a product that is far more versatile and effective in the movement of complex blanks that can be affected by the sail effect during rotations with respect to the solutions proposed by the prior art. Preferably, a component of controlled rotation between the first gripping portion with respect to the second gripping portion is carried out in a region of proximity of said first folding zone of said blank.

In this way, it is possible to reduce and control the damages produced in the material of the blank during the step of mutual rotation of the various parts, since they are carried out mainly in a zone of preferential failure and therefore, in this sense, structurally advantageous and provided.

Preferably, said proximity region is identified with a portion of the space surrounding said retention device and in which said first folding zone of said blank is located when secured thereto.

In one embodiment, said proximity region has a spacing from said blank (more preferably from said first folding zone of said blank) when it is secured to said retention device which is equal to 10 times the thickness of said blank, more preferably equal to 5 times the thickness of said blank and even more preferably equal to 2 times the thickness of said blank.

In another embodiment, said proximity region has a spacing from a retention surface of said blank defined on said first gripping portion or on said second gripping portion which is equal to 20 mm, more preferably equal to 15 mm and even more preferably equal to 10 mm.

In this way it is possible to let the rotation of the blank happen in such a manner that the local deformations linked to the rotation are substantially the predominant deformations, i.e. that the deformations induced by any translations of the material of the blank are negligible compared to those produced by the rotation, and that the latter are contained.

The person skilled in the art will be able to assess the most appropriate proximity interval depending on the thickness and type of material of the blank to be treated.

In fact, it is possible that materials with a lower elastic modulus (therefore more yielding) than others can tolerate greater proximity intervals than those tolerable by more rigid materials.

In this way it is possible to proceed efficiently and quickly with the movement steps of the blank without causing excessive damages.

Preferably, said first folding zone coincides with a creased portion of said blank. Thanks to this solution, it is possible to mutually rotate the desired portions of the blank, producing a very limited amount of damage in the material as the creasing zones are structurally and functionally designed to allow easy rotations about them.

Preferably, such creased portion is parallel to the longitudinal direction of development of the blank.

Preferably, said movement mechanism is configured to carry out a pure rotation of said second gripping portion with respect to said first gripping portion about a virtual rotation axis which is located outside said retention device.

In this way it is possible to carry out a specific movement of the first gripping portion with respect to the second gripping portion in which the axis of pure rotation is not located in the retention device and that it is therefore possible to overcome the rotational limitations introduced by the overall steric dimensions of the kinematic mechanisms which are rotating about a real rotation axis of the device, thus giving the blank the possibility to flex and deform in a freer manner, better following its internal structural requirements and therefore causing less damage.

This is advantageous, for example, if it is wished to bring the blank into a certain configuration by folding one portion with respect to one other, or also to carry out a step of pre-folding of a portion of the blank, so that this folded portion is already deformed locally and therefore shows less rigidity during a subsequent folding. This facilitates and improves the following forming steps. More in detail, as can be deduced from what has been pointed out so far, the pre-folding finds advantageous application in particular for blanks of larger dimensions (i.e., as the dimension of the blank increases, the benefit that can be obtained with the pre-folding step increases).

Preferably, said movement mechanism is configured to move in roto-translation said second gripping portion with respect to said first gripping portion.

In this way it is possible to realise an efficient articulated movement system that is able to modify the resulting real rotation radius of the second gripping portion with respect to the first gripping portion thanks to a translation in such a manner that the resultant is a pure rotation with respect to the virtual rotation axis.

In fact, thanks to this technical solution it is possible to correct the deformations of a translational nature that the second moving gripping portion with respect to the first would induce in the material of the blank.

In other words, considering that, in this case, the pure rotation, and thus the rotation with constant radius, is by definition only possible about the virtual rotation axis (which does not correspond to a real rotation axis of a rotating element), one way of physically carrying out this specific type of movement is to correct the rotations on a real radius (which is different from the virtual rotation axis) by simultaneously moving in translation the second gripping portion with respect to the first one.

Preferably, said movement mechanism comprises an articulated parallelogram which is secured to said first gripping portion and said second gripping portion. In this way, it is possible to move in roto-translation said second gripping portion with respect to said first gripping portion, thus reducing the damages produced in the material of the blank during movement.

Preferably, said articulated parallelogram comprises a first rod which is secured by means of a first hinge to a first rotation point of said first gripping portion.

Preferably, said first hinge is near a first end of said first rod.

Preferably, said articulated parallelogram comprises a second rod which is secured by means of a second hinge to a second rotation point of said first gripping portion.

Preferably, said second hinge is near a first end of said second rod.

Preferably, said articulated parallelogram comprises a third rod comprising a first pin which is secured with possibility to rotate to said first rod, a second pin which is secured with possibility to rotate to said second rod and a third pin which is secured with possibility to rotate to a third rotation point of said second gripping portion.

Preferably, said articulated parallelogram comprises a fourth rod comprising a fourth pin which is secured with possibility to rotate to said first rod, a fifth pin which is secured with possibility to rotate to said second rod and a third pin which is secured with possibility to rotate to a fourth rotation point of said second gripping portion.

Preferably, said first and second rotation points and said virtual rotation axis are aligned with each other.

Preferably, said third and fourth rotation points and said virtual rotation axis aligned with each other.

Preferably, said articulated parallelogram is realised in such a manner that when said first and second rods are rotated with respect to said first and second rotation points through the same angle, said third and fourth rods follow a translational movement with respect to said first gripping portion while maintaining a mutual parallelism condition, thereby varying the angular orientation of said second gripping portion with respect to said first gripping portion by rotating about said virtual rotation axis.

Thanks to this technical solution, it is possible to realise a retention device in a simple and cost-effective way that can be easily adapted according to variations in the first or second gripping portion or in the preferred position in space of the virtual rotation axis.

In addition, this structure guarantees excellent solidity and reliability during use even at high speed and frequency of movement.

Preferably, said virtual rotation axis is located outside said retention device and in a region of proximity of said retention device. Preferably, said proximity region is identified with a portion of the space surrounding said retention device and in which said blank is located when it is secured to the retention device.

In an embodiment, said proximity region has a spacing from said blank when it is secured to said retention device which is equal to 10 times the thickness of said blank, more preferably equal to 5 times the thickness of said blank and even more preferably equal to 2 times the thickness of said blank.

In another embodiment, said proximity region has a spacing from a retention surface of said blank defined on said first gripping portion or on said second gripping portion which is equal to 20 mm, more preferably equal to 15 mm and even more preferably equal to 10 mm.

In this way it is possible to let the rotation of the blank happen in such a manner that the local deformations linked to the rotation are substantially the predominant deformations, i.e. that the deformations induced by any translations of the material of the blank are negligible compared to those produced by the rotation, and that the latter are contained.

The person skilled in the art will be able to assess the most appropriate extent of the proximity region depending on the thickness and type of material of the blank to be treated.

In this way it is possible to proceed effectively and quickly with the movement of the blank while ideally limiting the damages.

Preferably, said virtual rotation axis passes through said blank when it is retained by said retention elements.

In this way it is ensured that in the material of the blank there is the least possible optimal deformation (and therefore the least damage) since only a pure rotation acts in it without any further contribution of translation. In fact, as previously argued, the addition of a translational component on the blank would induce a further deformation component in the blank.

Preferably, said virtual rotation axis coincides with a region of greater yielding of the blank, i.e. the first folding zone. More preferably, said virtual rotation axis coincides with a creased portion in said blank.

In this way, it is possible to further contain and control the deformation induced in the blank as it occurs in the zone of the creased portion which is structurally and functionally configured to allow rotations about itself.

Preferably, said virtual rotation axis is near an edge of said first gripping portion facing said second gripping portion of said blank.

In this way, the rotation of said first gripping portion with respect to said second gripping portion is even more precise and effective.

Preferably, said first and second retention elements are substantially planar.

This makes it possible to retain portions of the planar blank ideally and firmly during the movement thereof.

Preferably, said retention elements are suction cups or other pneumatic means. Thanks to this solution, it is possible to firmly retain surfaces of the blank in a fixed manner with the retention device during all the desired movements.

In one embodiment, said first gripping portion is fixedly secured to said support. In another preferred embodiment, said retention device comprises a movement device configured to move in translation said first gripping portion and said second gripping portion.

Preferably, said movement device moves in translation simultaneously said first and second gripping portion.

Preferably, said first and second gripping portion are moved in translation with respect to said support or with respect to one other predetermined reference, such as for example a drum on which the retention device is mounted.

Thanks to this technical solution, it is possible to facilitate the grip, the transfer and the movement of the blank by adding an additional movement component of the first and second gripping portion.

Preferably, such a movement device may comprise cam kinematics or a track-runner system or even a device that moves following the rotation of a worm screw.

Preferably, said first gripping portion and said second gripping portion are mounted on a drum and can be moved in translation in a direction having a radial component of said drum.

In this way it is possible to further modify the direction in which the retention device moves. In particular, this variation may be implemented near or at the removal and/or release and/or folding zones.

Preferably, said movement unit comprises a pre-folding device configured to cooperate with said retention device to fold predetermined portions of said blank.

In this way, said parts of the blank, such as creased portions, strips, flaps, etc., can be deformed or yielded to make them less rigid and therefore easier to work, thus improving and simplifying subsequent gluing or jointing.

Moreover, said technical solution also makes it possible to better manage the spatial arrangement of predetermined portions, particularly when it comes to panels or flaps, in order to ideally guide them in the desired orientations to additional movement devices.

Preferably, said first gripping portion of said retention device is placed upstream with respect to said second gripping portion in a rotation direction of said drum.

Thanks to this technical solution it is possible to improve the control of the blank during the rotation of the drum by producing a retention constraint on the portion of the blank downstream of said first gripping portion of the retention device, which is the first to be subjected to the relative air flow produced during rotation and therefore the one most subject to the possibility of producing the sail effect described above.

Preferably, said drum comprises a cam type rotation mechanism configured to produce a variation in angular rotation speed of said retention device with respect to said drum.

In this way it is possible to vary the angular speed of the retention device with respect to the angular speed of the drum, possibly even succeeding in producing a stoppage of the retention device while the drum continues its rotary movement uninterruptedly. Thanks to this technical solution, it is possible to carry out operations relative to the blank (e.g. folding, removal, release, etc.) when it has a speed practically equal to zero.

According to one embodiment, said cam type rotation mechanism also acts as a movement device which allows moving the first and second gripping portion of the retention device in a direction having a radial component with respect to the rotation axis of the drum. Furthermore, thanks to this cam type rotation mechanism, it is also possible to rotate said first gripping portion and/or said second gripping portion with respect to the radial direction of the drum.

Preferably, said movement unit comprises a plurality of retention devices which are arranged so as to be equidistant with angular spacing in accordance with an axis of symmetry which passes through the rotation axis of said drum.

Thanks to this technical solution it is possible to further increase the process speed while maintaining a mono-flow advance of the blanks.

Preferably, said plurality of retention devices is equal to three.

The Applicant has assessed that this technical solution represents an ideal compromise between the process speed of the blanks, the overall steric dimensions of the retention devices in the rotating drum and the consequent maximum usable angular speed in order to optimise productivity by reducing the risk of damage due to possible collisions among moving parts.

Furthermore, this solution identifies an ideal compromise between productivity and the weight of the retention devices applied to the drum.

Preferably, said movement unit comprises a plurality of said drums each one comprising at least one of said retention devices and said plurality of retention devices being arranged in such a manner as to be able to exchange said blank between a first retention device and a second retention device which are secured to different drums, respectively.

Thanks to this technical solution, it is possible to easily, effectively and quickly carry out the passage of blanks by changing their orientation with respect to the presented faces and thus optimally controlling the position of the desired portions of the blank.

Preferably, said packing apparatus comprises said movement unit and a second movement unit comprising an additional retention element which is configured to be able to receive said blank from said retention device of said movement unit retaining it.

Thanks to this technical solution, it is possible to effectively exchange the blank between different working stations.

Preferably, said rotation axis of said drum is substantially parallel to said first folding zone.

In this way, it is possible to achieve an optimum constraint of the blank on the retention device even when the possibility of the lateral panel to flex according to the sail effect would be maximum.

Preferably, the blank is provided so that said first folding zone is disengaged.

In this way, the retention produced on the blank allows an optimal rotation about the first folding zone.

Preferably, said first folding zone is interposed between said first retention element and said second retention element.

In this way, the rotation of the first gripping portion with respect to the second gripping portion is particularly effective.

Preferably, said process comprises the step of rotating in a controlled manner at least one of said second gripping portion of said retention device and said first gripping portion of said retention device, while said drum rotates between said removal position and said release position, so as to bring about a rotation equal to an angle of inclination between 60° and 120° with respect to the radial direction of said drum.

In this way, an ideal balance is achieved between the sail effect produced on the blank, the retention that can be achieved on the latter and the overall steric dimensions of the movement unit during the rotations and the desired processing steps.

Preferably, said process comprises the step of at least partially carrying out said rotation in a controlled manner of said second gripping portion of said retention device with respect to said first gripping portion of said retention device as a pure rotation about a virtual rotation axis that is located outside said retention device.

Preferably, said virtual rotation axis passes through said first folding zone, which even more preferably is a creased portion of said blank.

In this way, the sail effect produced on the blank can be managed as desired, minimising the deformations induced in the material of the blank during possibly rotations.

Preferably, the process comprises the step of activating said first retention element of said retention device by fixedly securing said central panel to said first retention element.

Preferably, the process comprises the step of activating said second retention element of said retention device by fixedly securing said lateral panel to said second retention element, causing said first folding zone to be disengaged and interposed between said first retention element and said second retention element.

In this way the effectiveness of the rotation produced between the first and second gripping portion of said blank is improved.

Preferably, said process comprises the step of retaining an abutment panel of said blank by means of said first gripping portion and a lateral panel of said blank by means of said second gripping portion, in such a manner that said lateral panel is downstream with respect to said abutment panel in accordance with said rotation direction of said drum.

Thanks to this embodiment, it is possible to manage the control of the lateral panel of the blank during the rotation of the drum the lateral panel of the blank, if left free, would tend to flex freely, risking getting caught in parts of the retention unit or outside it, thus risking compromising the movement process according to the sail effect described above.

Preferably, the process comprises the step of activating a movement device which is configured to move said blank in a direction having a radial component with respect to said rotation axis of said drum.

In this way it is possible to arrange the retention device in a more proximal or distal radial configuration with respect to the drum, facilitating, according to need, the steps of removing up and/or releasing the blank or their movement. Preferably, as said drum rotates between said removal position and said release position, a desired folding of said blank is produced by means of said retention device.

In other words, the process provides for being able to carry out a specific folding of said blank with minimisation of the damages resulting from deformation while it is retained by said retention device, thanks to the possibility of rotating the second gripping portion with respect to the second gripping portion about to the virtual rotation axis.

Preferably, while said drum rotates between said removal position and said release position, the process comprises the step of producing a desired folding of longitudinal attachment flaps of said blank by means of a pre-folding device which collaborates with said first and second gripping portion.

In this way it is possible to further deform the first folding zone and to make it more yielding so that the blank is more workable in the following steps.

Preferably, other portions of the blank, such as the longitudinal flaps, can also be folded by means of said pre-folding device.

Preferably, during the rotation of said drum, a stoppage of said retention device is produced.

In particular, it is preferred that such a stoppage of the retention device is produced during the removal and/or release step of the blank and/or during a folding or pre-folding step of the blank.

In this way it is possible to reduce the relative speed of the retention device by letting it stop and making any desired operations to be carried out with or on the blank easier and more effective.

Preferably, said stoppage is obtained by means of said cam type rotation mechanism.

Preferably, the process comprises the step of rotating a first drum of said movement unit which retains said blank towards said release position and of rotating a second drum of said movement unit in a synchronized manner with said first drum.

Preferably said second drum rotates with an opposite direction to said first drum. Preferably, the process provides for facing said second gripping portion of said retention device which is secured to said first drum with a second gripping portion of a retention device which is secured to said second drum.

Preferably, the process provides for facing said first gripping portion of said retention device which is secured to said first drum with a first gripping portion of said retention device which is secured to said second drum.

Preferably, the process provides for maintaining said retention elements of said retention device which is secured to said first drum while the retention elements of said retention device which is secured to said second drum are also activated. Preferably, the process provides for deactivating said retention elements of said retention device which is secured to said first drum while said retention elements of said retention device which is secured to said second drum are kept active.

In this way, it is possible to quickly and precisely transfer the blank from a first drum to a second drum and thus continue the aforesaid process for moving said blank in a continuous and uninterrupted manner.

Preferably, the process further provides for rotating said second drum as far as a release position and, in the meantime, rotating about a virtual rotation axis a second gripping portion with respect to a first gripping portion of said retention device which is secured to said second drum.

Preferably, said retention device is moved in a direction having a radial component with respect to a rotation axis of said drum.

In this way, it is possible to move the blank even more effectively in order to have it engaged on desired devices or stations.

Preferably, the process comprises the step of activating an additional movement unit comprising an additional first retention element which is configured to remove said blank from said movement unit when it has completed said release.

In this way, it is possible to effectively exchange between different movement units of the blank in order to proceed with the desired workings.

The characteristics and advantages of the invention will become clearer from the detailed description of an embodiment illustrated, by way of non-limiting example, with reference to the appended drawings wherein.

Figure 1:
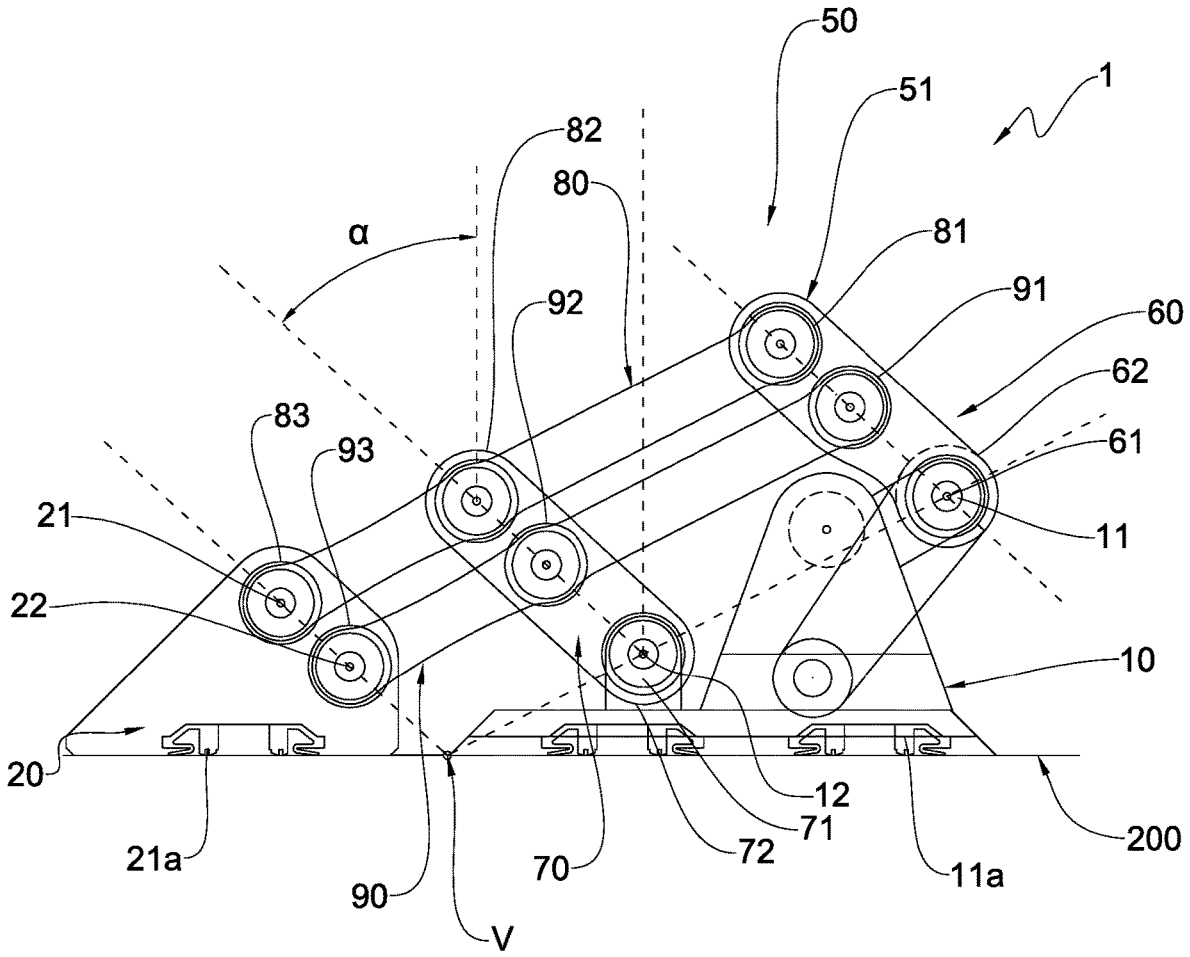
FIG. 1 is a schematic side view of a retention device in an aligned configuration made in accordance with the present invention.
Figure 2:
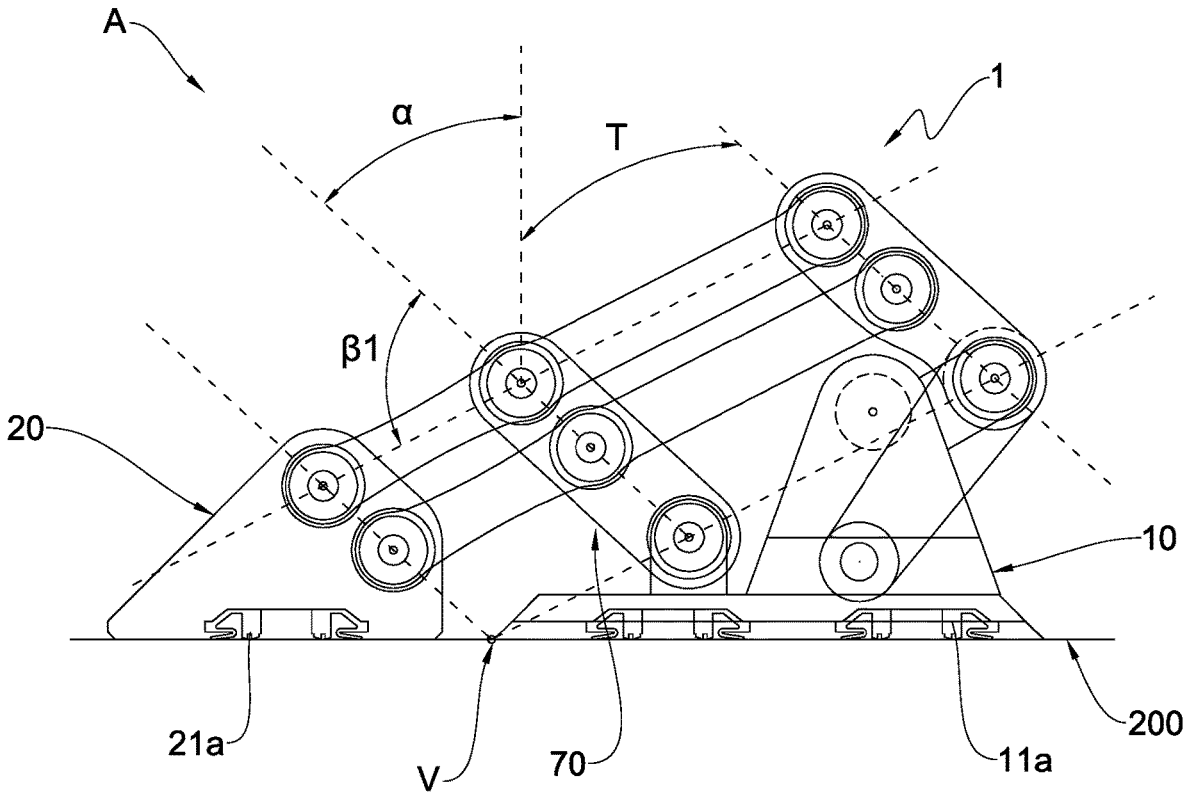
FIG. 2 is a further schematic side view of the retention device in FIG. 1.
Figure 4:
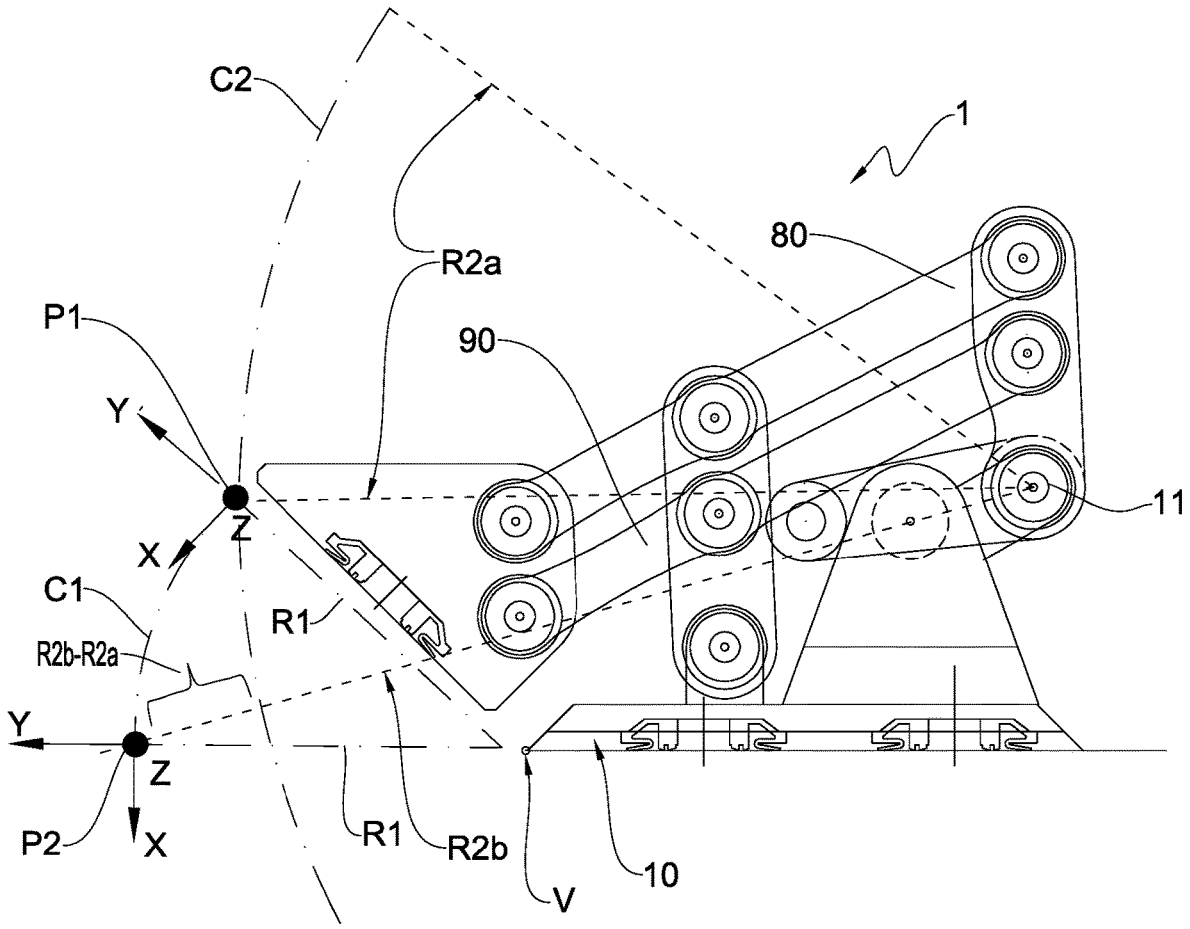
FIG. 4 is a further schematic side view of the retention device in FIG. 3.
Figure 5A:
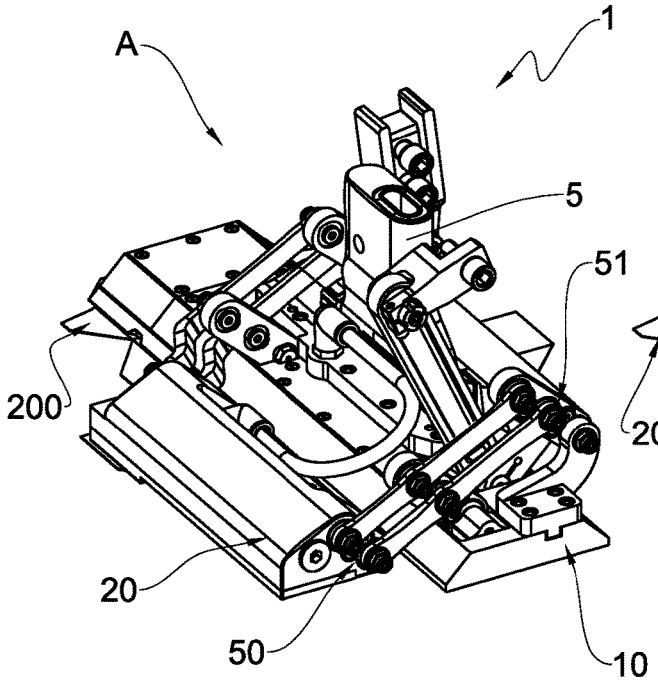
Figure 5B:
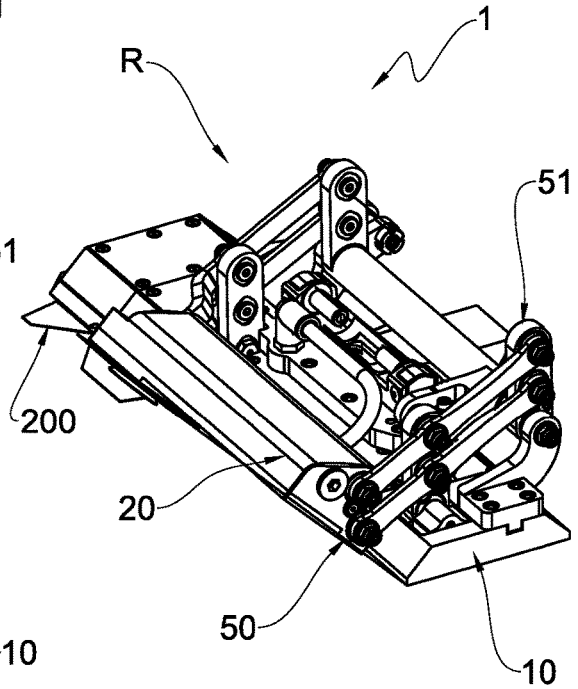
Figure 5C:
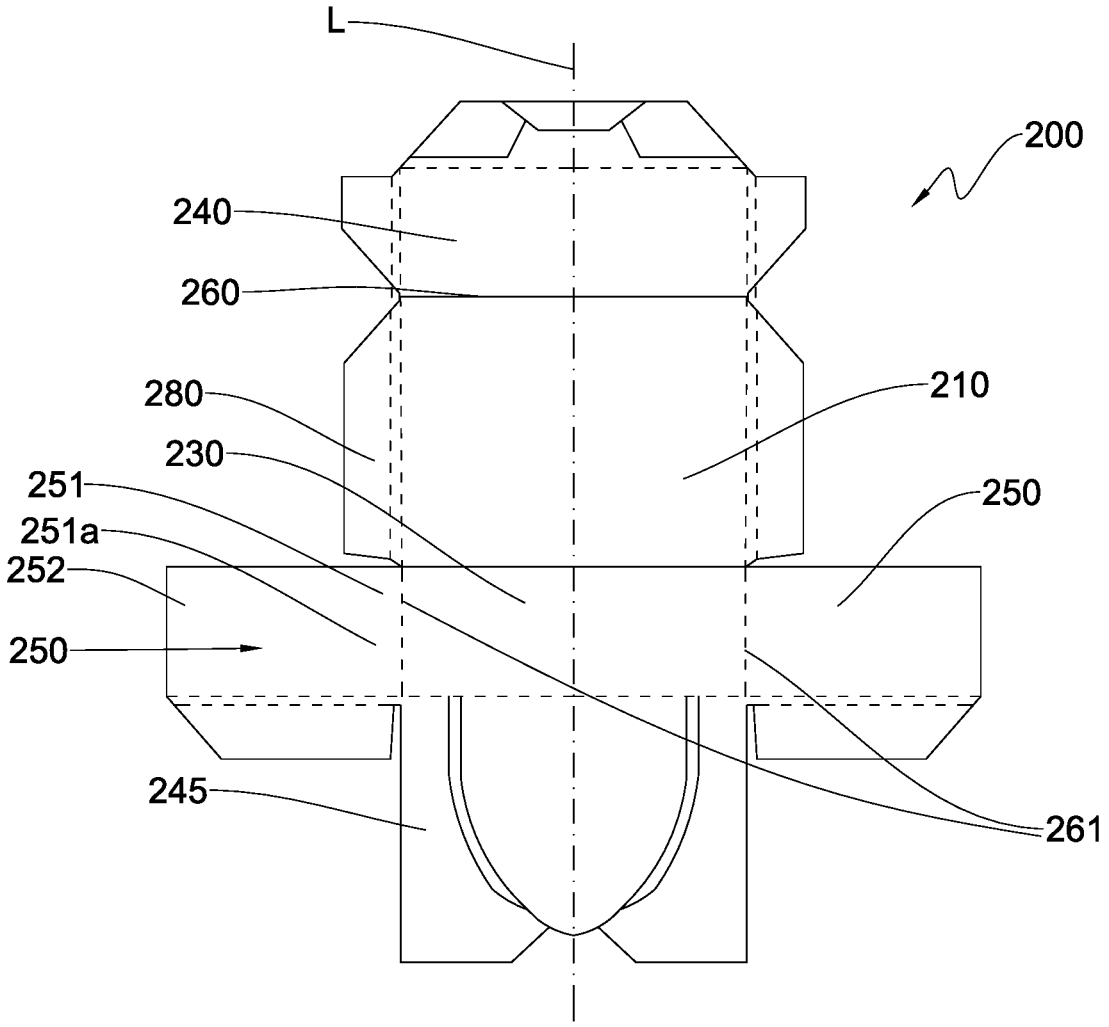
Figure 6:
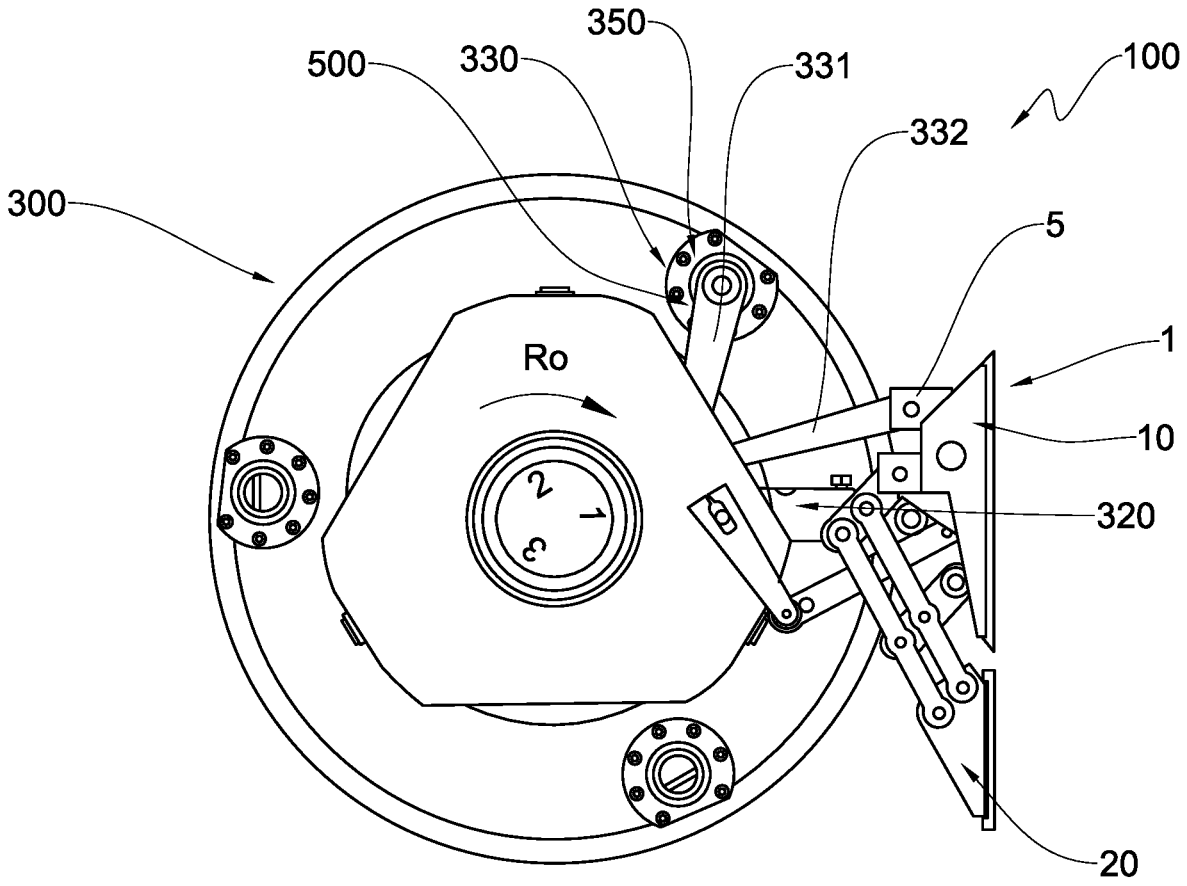
Figure 10:
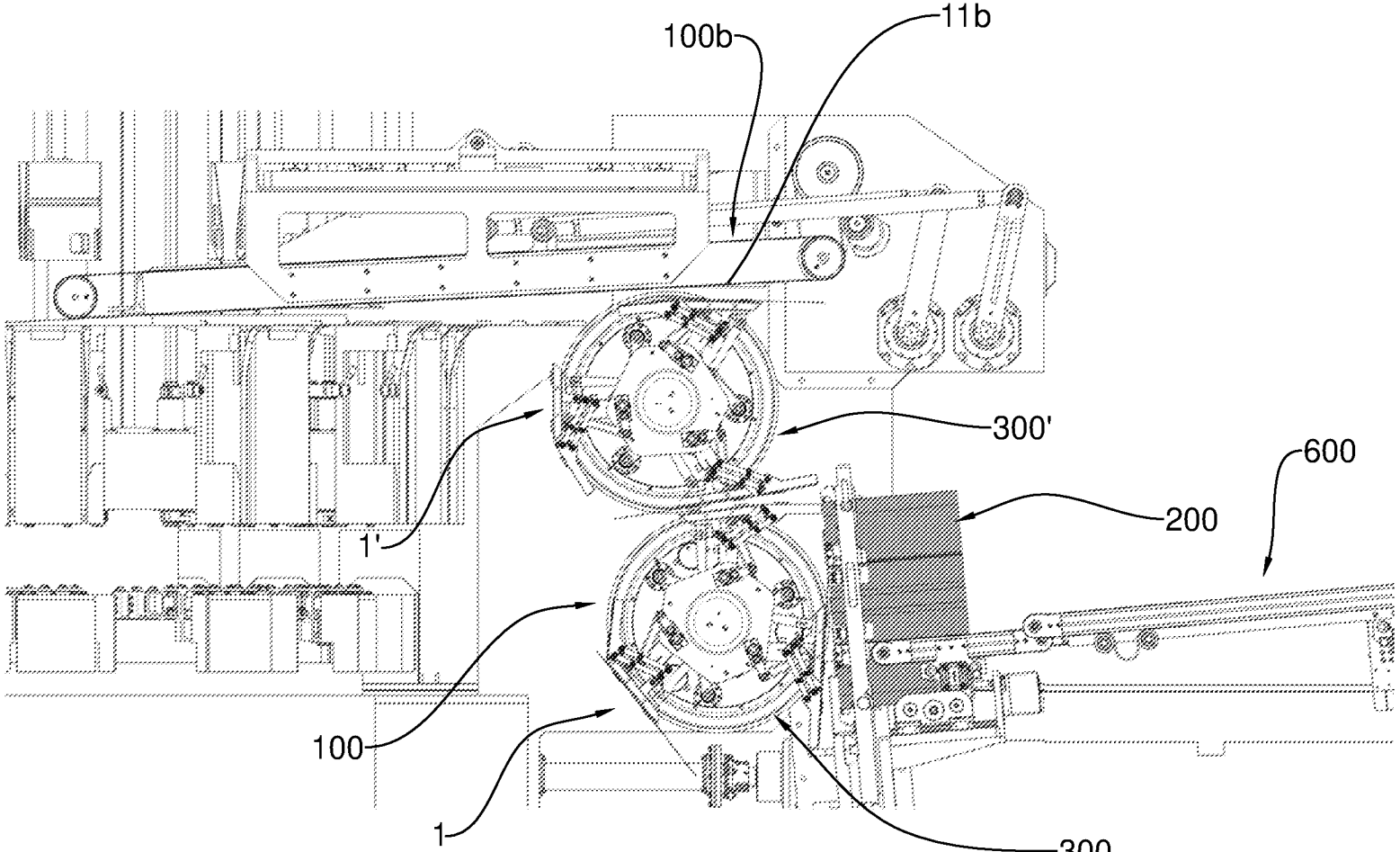
Figure 11:
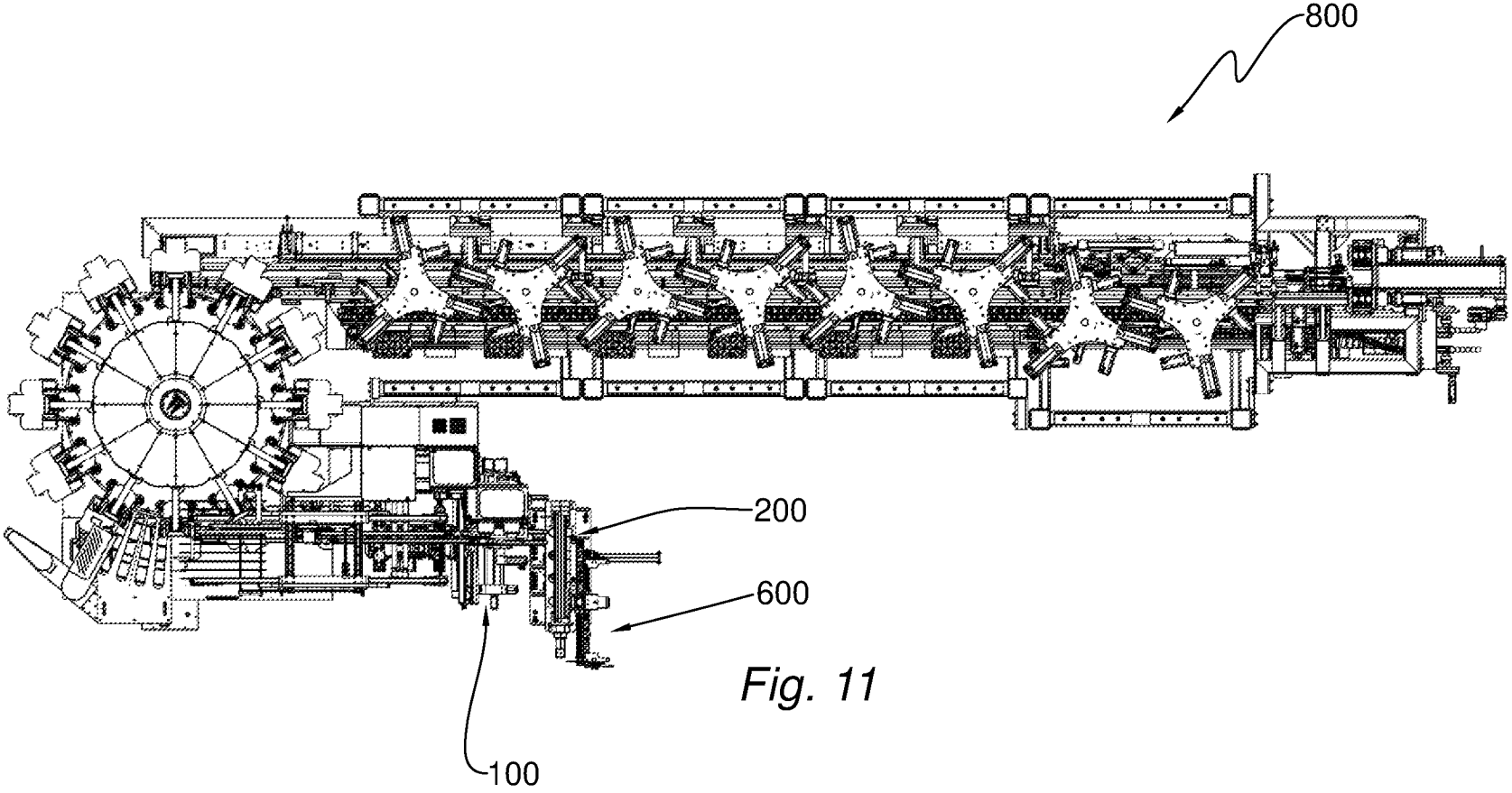

FIGS. 5*a* and 5*b* are a perspective view of the retention device in FIG. 2 and FIG. 4 respectively;

FIG. 5*c* is a top view of a blank usable by the present invention;

FIGS. 6, 7, 8*a*, 8*b* and 9 each represent a schematic side view of a movement unit provided with the retention device of FIG. 1 in a different operational step;

FIG. 10 is a schematic side view of a further embodiment of the movement unit in FIG. 6;

FIG. 11 is a top view of a packing apparatus for articles comprising the forming unit in FIG. 6.

With initial reference to FIG. 11, 800 denotes a packing apparatus which is provided to form a container from a blank 200 and, further, to fill the container thus formed with a plurality of loose articles, so as to obtain a finished packaging intended to be packaged for shipment.

The embodiment example described below relates to articles to be packed in a container, in particular a box-shaped container in which articles that are different from each other, or the same but in different configurations, are arranged in a sorted manner, for example arranged on superimposed layers.

In the specific case described herein, the articles with which the containers are filled are capsule elements for the preparation of infusion drinks, in particular coffee capsules.

In the present example, each blank 200 is a flat laminar element made of foldable and semi-rigid material, for example cardboard, suitably cut and provided with preferential folding zones 251*a* which may be zones of reduced thickness, zones with predetermined uniform holes or similar technical solutions. Referring to FIG. 5*c*, the first folding zone 251*a* is preferably a creased portion 260.

As better visible in FIG. 5*c*, the blank 200 has a substantially cross shape comprising a front panel 230 with a quadrilateral shape from which additional panels branch out according to the normal directions of the respective edges.

More in detail, an abutment panel 210 and a closing panel 245 which is opposite the front panel 230 with respect to the abutment panel 210 are connected along the longitudinal axis L of its cross shape from the front panel 230. Again along the longitudinal direction L there is identified a rear panel 240 which is connected to the abutment panel 210 on the opposite side of the front panel 230.

Consistently with what has been described above, and again with reference to FIG. 5*c*, in this context the front panel 230 is identifiable as a central panel since opposed lateral panels 250, which are free to flex and rotate, are connected to it by means of creased portions. In fact, it is noted that each lateral panel 250 is secured to the front panel 230 at the first end thereof 251 and that the opposite second end 252 is free.

In particular, said opposed lateral panels 250 are connected to the front panel 230 at the other two edges thereof. The creased portions that are parallel to the longitudinal direction are defined as longitudinal creased portions and identified by the number 261.

All the aforementioned panels have a quadrilateral shape, preferably rectangular, so that the container obtained from the blank 200 is substantially box-shaped or parallelepiped.

In particular, the abutment panel 210 will define the bottom of the container, while the rear panel 240, the front panel 230, and the lateral panels 250 of the blank 200 will correspond respectively to the rear wall, the front wall and the lateral walls of the container. Finally, the closing panel 245 will define an openable wall of the container, intended to close an opening defined in the container by the rising of the lateral panels 250, the front panel 230 and the rear panel 240.

Preferably, the abutment and rear panels 210, 240 have, on each edge which branches parallel to the longitudinal axis L of the blank 200, respective longitudinal fixing flaps 280 having a trapezoid shape, with a free edge connected by inclined edges.

Further flaps can be made on any free edge of each panel of the blank.

The rear panel 240 has, in addition to the longitudinal fixing flaps 280, a closing flap which is articulated thereto on the opposite side of the abutment panel 210. With reference to FIGS. 6 to 9, various operating conditions of a movement unit 100 comprising a drum 300 and a retention device 1 are represented. The different components will be described in detail below.

Figure 8A:
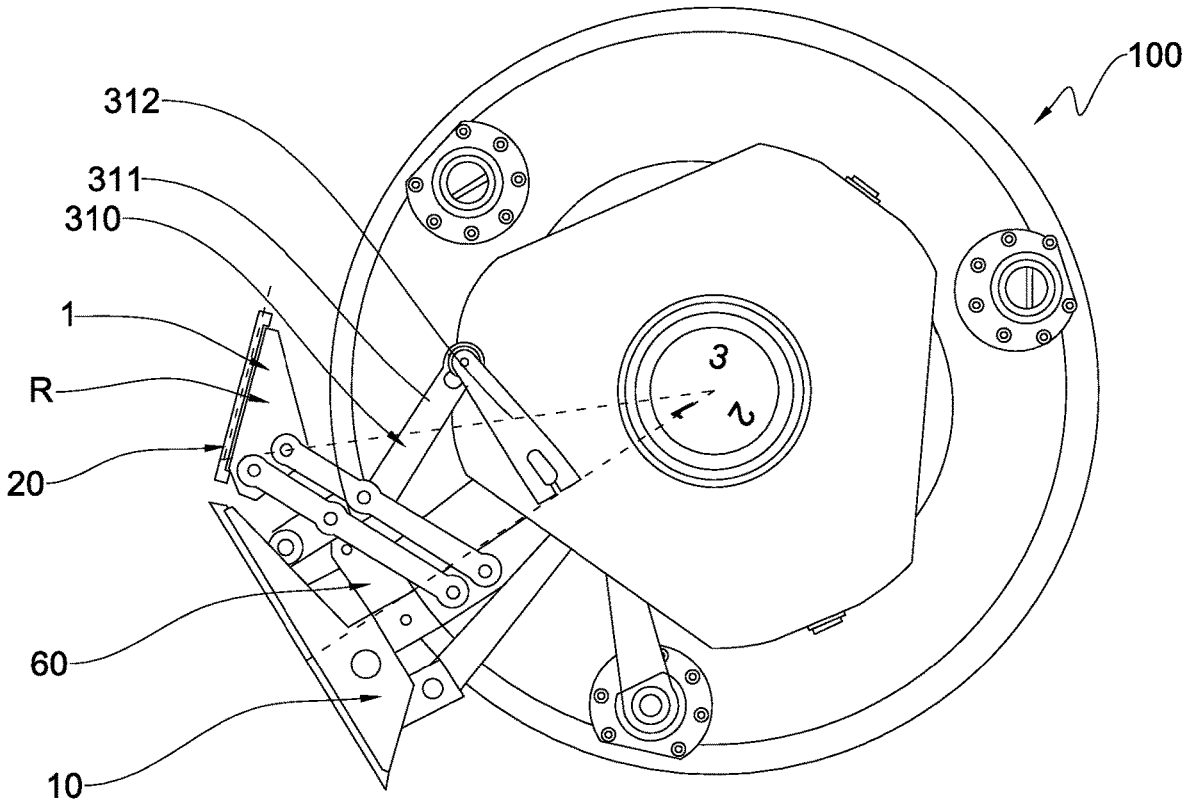
Figure 8B:
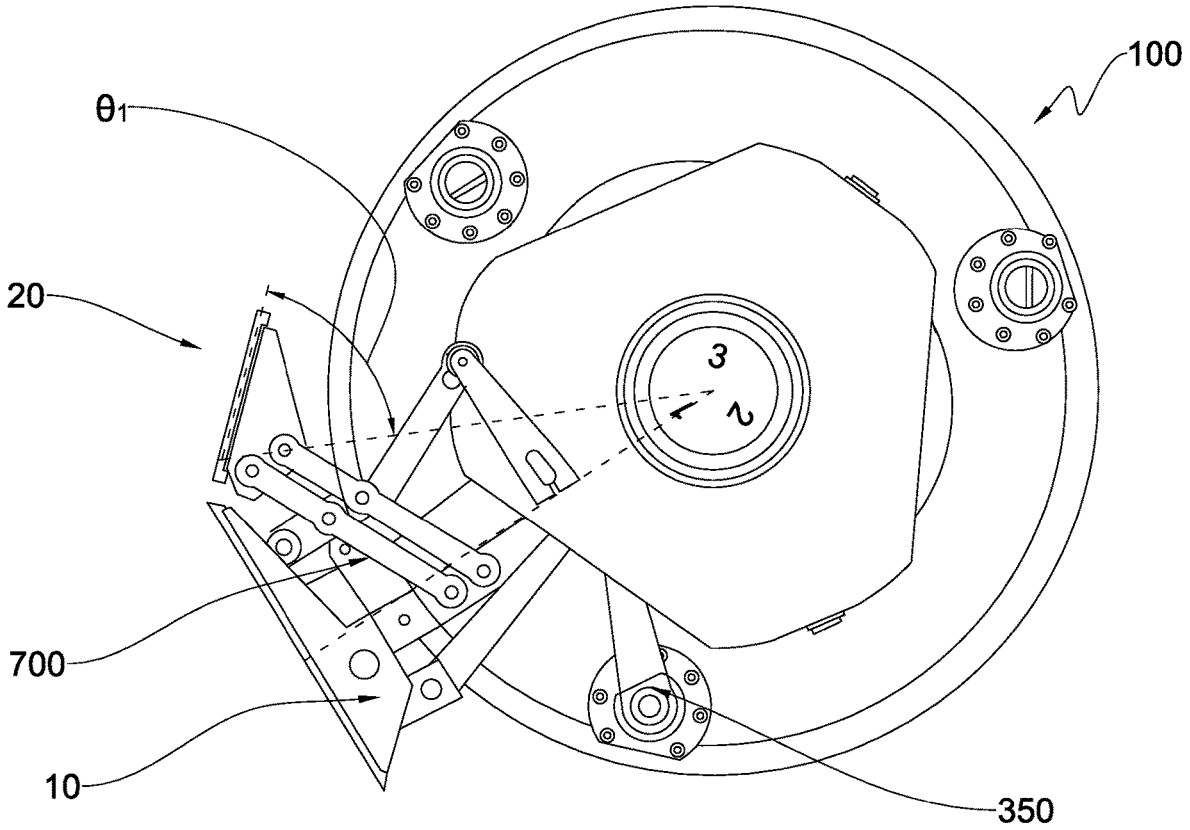
Figure 9:
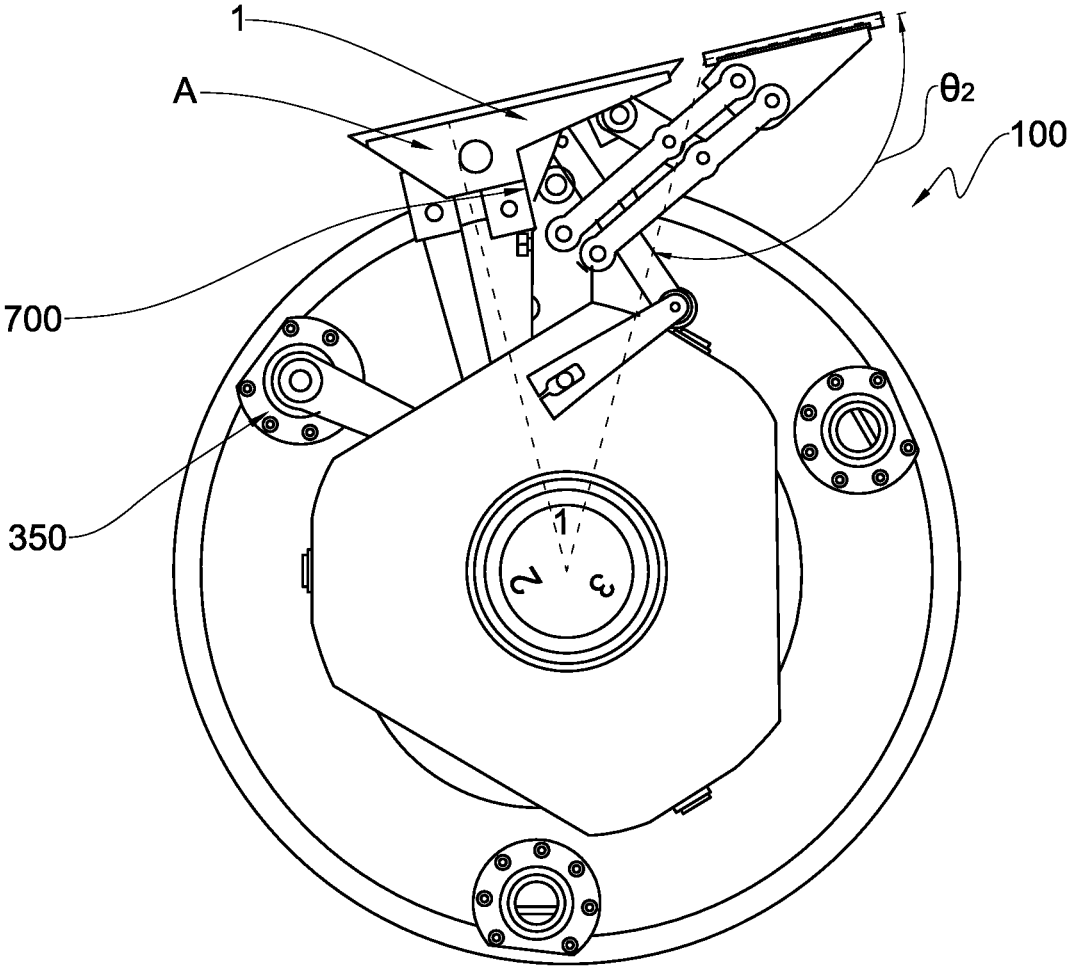

FIGS. 8*b* and 9 depict an embodiment of a rotation group 700, comprising in this case a movement mechanism 50 and a cam type rotation mechanism 350, which is configured to produce a controlled rotation of at least one between a first gripping portion 10 and a second gripping portion 20 of a retention device 1 relative to the radial direction of the drum 300 which is preferably defined by an angle of inclination θ between 60° and 120°. These technical aspects will be discussed in more detail below.

With reference to FIG. 1, an embodiment of a retention device 1 is shown which comprises a first gripping portion 10 which is provided to retain a portion of the blank 200 and a second gripping portion 20 which is provided to retain an additional portion of the blank 200. A support 5 corresponding to a solid portion to which the first gripping portion 10 is secured is identified in FIG. 6. This support 5 will be described below.

The first gripping portion 10 and the second gripping portion 20 comprise respectively first and second retention elements 11*a*, 21*a* of the blank 200 represented in FIGS. 1 to 4 as suction cups acting with pressure reduction.

Still with reference to FIGS. 1 to 4, it can be noted that the second gripping portion 20 is secured to the first gripping portion 10 by means of a movement mechanism 50 which is configured to carry out a pure rotation of the second gripping portion 20 about a virtual rotation axis V which is located outside the retention device 1. It should be noted that the virtual rotation axis V in FIGS. 1 to 4 is shown perpendicular to the plane of the sheet. From FIG. 1, it can be noted that the virtual rotation axis V is preferably defined on the blank 200 and even more preferably in coincidence with one of the longitudinal creased portions 261.

Figure 3:
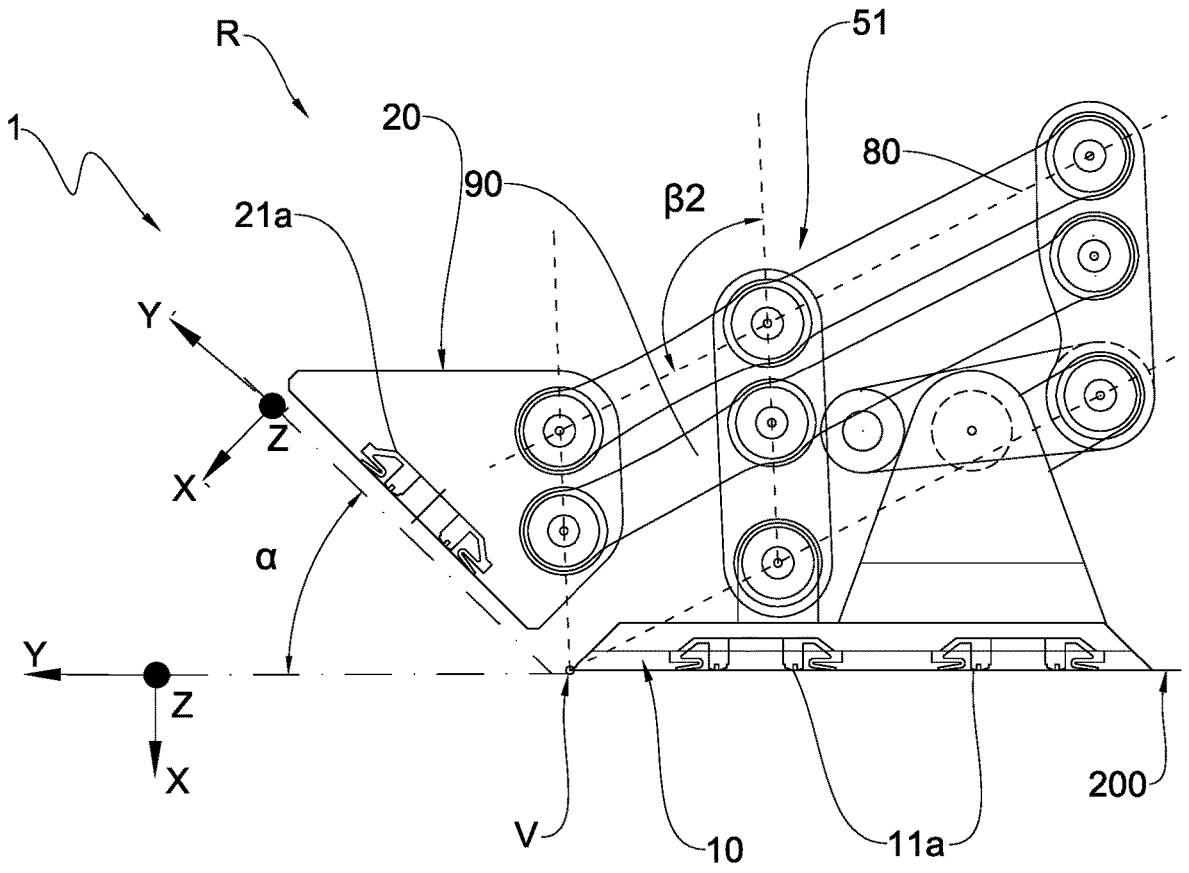
FIG. 3 is a schematic side view of the retention device of FIG. 1 in a rotated configuration.

In this way, the retention device 1 can move from an aligned configuration A, shown in FIGS. 1 and 2, in which a first retention surface 15 and a second retention surface 25 respectively of the gripping elements 11*a*, 21*a* of the first and second gripping portions 10, 20 are substantially aligned and coplanar with each other, to a rotated configuration R, shown in FIGS. 3 and 4, in which the aforesaid retention surfaces 15, 25 are transverse to each other.

Clearly, when in use, the retention elements 11*a* and 21*a* secure the blank 200 to the retention device 1 and which is also deformed according to the aligned configuration A or rotated configuration R. In this way it is possible to determine the extent of the sail effect acting on the blank 200.

Furthermore, the virtual rotation axis V passes near an edge of the first gripping portion 10 facing the second gripping portion 20, for example a few millimetres from said edge, so as to favour the folding of the blank 200 at the creased portion 261.

As argued above, it is significant to note that thanks to the retention device 1, it is possible to carry out a pure rotation about the virtual rotation axis V. The geometrical direction of said movement is represented in FIG. 4, in which a same point of the second gripping portion 20 is considered, which passes from the position P1 in rotated configuration R to the position P2 when in aligned configuration A. As can be clearly seen, the movement from P1 to P2 draws an arc of circumference C1 which is centred on the virtual rotation axis V having a fixed radius R1.

Again with reference to FIG. 4, it can be understood that this movement of pure rotation is only valid when the virtual rotation axis V is considered, whereas if other physical parts of the retention device 1 are taken into account, this type of movement requires a more complex description and performance.

In order to make this clearer, in FIG. 4 the movement of the same point previously analysed of the second gripping portion 20 in position P1 is considered, which carries out a pure rotation with respect to a reference point 11 (this arbitrary point will be discussed in more detail below).

Since the movement is pure rotation, all the components of the retention device 1 between the reference point 11 and the position P1 must be considered as being fixedly secured to each other, i.e. as a rigid body. As can be noted again from FIG. 4, the point of the second gripping portion 20 in the position P2 now determines a second radius R2*a* with respect to the reference point 11 that identifies a second arc of circumference C2. By drawing the segment R2*b* which joins the position P2 of the second gripping portion 20 with the reference point 11, it is clear that this radius is greater than the second radius R2*a*. In fact, it is immediately evident that in order for the second gripping portion 20 to be able to move from the second arc of circumference C2 as far as the position P2 is reached, it is necessary to add a translational movement having a component equal to the absolute value of the difference of the two radil R2*b* and R2*a* (|R2*b*-R2*a*|). This therefore implies that, with respect to the reference point 11, the second gripping portion 20 carries out, in the embodiment considered, a roto-translation movement.

It is also interesting to note that according to the pure rotation considered about the reference point 11, the vector XYZ in position P1 would not arrive with the same orientation as the one in position P2 and that probably the second gripping portion 20 would be hindered in its rotation by the presence of the first gripping portion 10.

In fact, in order for the second gripping portion 20 to be able to reach the second position P2, there must be a translation that allows the second gripping portion 20 to avoid colliding on the first gripping portion 10. In addition, it is necessary that there is a further variation of the rotation so as to be able to align the triad of unit vectors XYZ as desired.

The movement mechanism 50 shown in FIGS. 1 to 4 is an articulated parallelogram 51 which is secured to the first gripping portion 10 and to the second gripping portion 20. Said articulated parallelogram 51 comprises a first rod 60 comprising a first hinge 61 which is located near a first end 62 of the first rod 60 and the first rod 60 being secured by means of the first hinge 61 to a first rotation point 11 (previously used as an example of a possible reference point) of the first gripping portion 10.

Furthermore, said articulated parallelogram 51 comprises a second rod 70 comprising a second hinge 71 which is located near a first end 72 of the second rod 70 and the second rod 70 being secured by means of the second hinge 71 to a second rotation point 12 of the first gripping portion 10.

The articulated parallelogram 51 also comprises a third rod 80 comprising a first pin 81 which is secured with possibility to rotate to the first rod 60, a second pin 82 which is secured with possibility to rotate to the second rod 70 and a third pin 83 which is secured with possibility to rotate to a third rotation point 21 of the second gripping portion 20.

Finally, said articulated parallelogram 51 comprises a fourth rod 90 comprising a fourth pin 91 which is secured with possibility to rotate to the first rod 60, a fifth pin 92 which is secured with possibility to rotate to the second rod 70 and a third pin 93 which is secured with possibility to rotate to a fourth rotation point 22 of the second gripping portion 20.

As can be noted from FIGS. 1 to 4, thanks to this specific embodiment of an articulated parallelogram, the virtual rotation axis V remains unambiguously determined by the intersection of the line joining the first and second rotation points 11, 12 and the line joining the third and fourth rotation points 21, 22. In other words, it is as if the virtual rotation axis V were the ninth pin, fixed, of the articulated parallelogram 51 described above.

Thus, when the first and second rods 60, 70 are rotated with respect to said first and second rotation points 11, 12 through the same angle α, the third and fourth rods 80, 90 follow a translational movement T with respect to said first gripping portion 10 while maintaining a mutual parallelism condition.

Referring now to FIGS. 2 and 3, it can be noted that the angle with which the second gripping portion 20 rotates to reach the rotated configuration R is the same angle α with which the first and second rods 60, 70 rotate with respect to their position in the aligned configuration A (e.g. the angle α with respect to the second pin 82 is shown).

Again with reference to FIGS. 2 and 3, the orientation of the third rod 80 with respect to the second rod 70 is now considered: it is noted that in the aligned configuration A (shown in FIG. 2) the angle between them is equal to β1, while in the rotated configuration R (shown in FIG. 3) the angle between them is varied and equal to β2.

Therefore, during the movement from the aligned configuration A to the rotated configuration R, a plurality of rotations contribute together with a translational contribution of the second gripping portion 20 with respect to the first gripping portion 10.

This condition is also represented by the perspective views shown in FIGS. 5*a* and 5*b*. They correspond respectively to FIGS. 2 and 3 previously described in which the folding of the blank 200 which is secured to the retention device 1 in the aligned configuration A and rotated configuration R can be further evaluated. With reference to FIG. 1 and FIG. 8*a*, it can be noted that the rod 60 has a lateral extent at the end thereof 62 which gives it an overall "L" shape. The free lateral end of this "L" is configured to be able to be moved by a first actuator 310 that causes the first rod 60 to rotate about the first pin 61, thereby reversibly letting the retention device 1 pass from the aligned configuration A to the rotated configuration R.

FIGS. 6 to 9 show a movement unit 100 comprising a drum 300 to which the retention device 1 is secured.

With reference to FIG. 8*a*, it can be seen that the first actuator 310 comprises a first actuating rod 311 and a second actuating rod 312 which are secured to each other with possibility to rotate by means of a hinge and the first actuator rod 311 being connected to the lateral extent of the first rod 60 with possibility to rotate and the second actuating rod 312 being connected with possibility to rotate to an actuating motor (not shown in the figure) of the drum 300.

With reference to FIG. 6, a second actuator 320 and a third actuator 330 are identified, both connected to the first gripping portion 10.

In this embodiment, the second actuator 320 is a rod which is connected at one end thereof to the first gripping portion 10 and at the other end to the drum 300. Said second actuator 320 collaborates with the third actuator 330 which comprises a first and a second bar 331, 332 which are connected to each other with possibility to rotate and the first bar 331 being connected to the drum 300 while the second bar 332 is connected with permitted rotation by means of a hinge with possibility to rotate to the support 5 which is secured to the first gripping portion 10.

In this manner it is possible to move said first and second gripping portion 10, 20 with respect to the drum 300.

It is interesting to note that, again with reference to FIGS. 6 to 9, the second actuator 320 and the third actuator 330 thus described can serve both as a movement device 500, configured to move in translation simultaneously the first and second gripping portion 10, 20 with respect to the drum 300 in a direction having a radial component of the drum 300, and as a cam type rotation mechanism 350 that allows to carry out a stoppage of the retention device 1 with respect to the continuous rotation movement of the drum 300.

In alternative embodiments (not shown in the figures), a movement device 500 is provided to be realised comprising a track which is secured to the support 5 and a runner which is secured to the first gripping portion 10. Also in this way it is possible to carry out a further movement of the first and second gripping portion 10, 20 with respect to the drum 300.

According to one embodiment, the retention device comprises lightweight materials with a high modulus of elasticity such as fibreglass or carbon fibre composites. In addition, the retention device 1 includes devices for the rapid disengagement from the drum 300 in order to be able to replace it quickly and easily.

FIG. 6 shows the movement unit 100 in a removal position, wherein the retention device 1 may activate the retention elements 11*a*, 21*a* to remove a blank 200 from a horizontal hopper 600.

Figure 7:
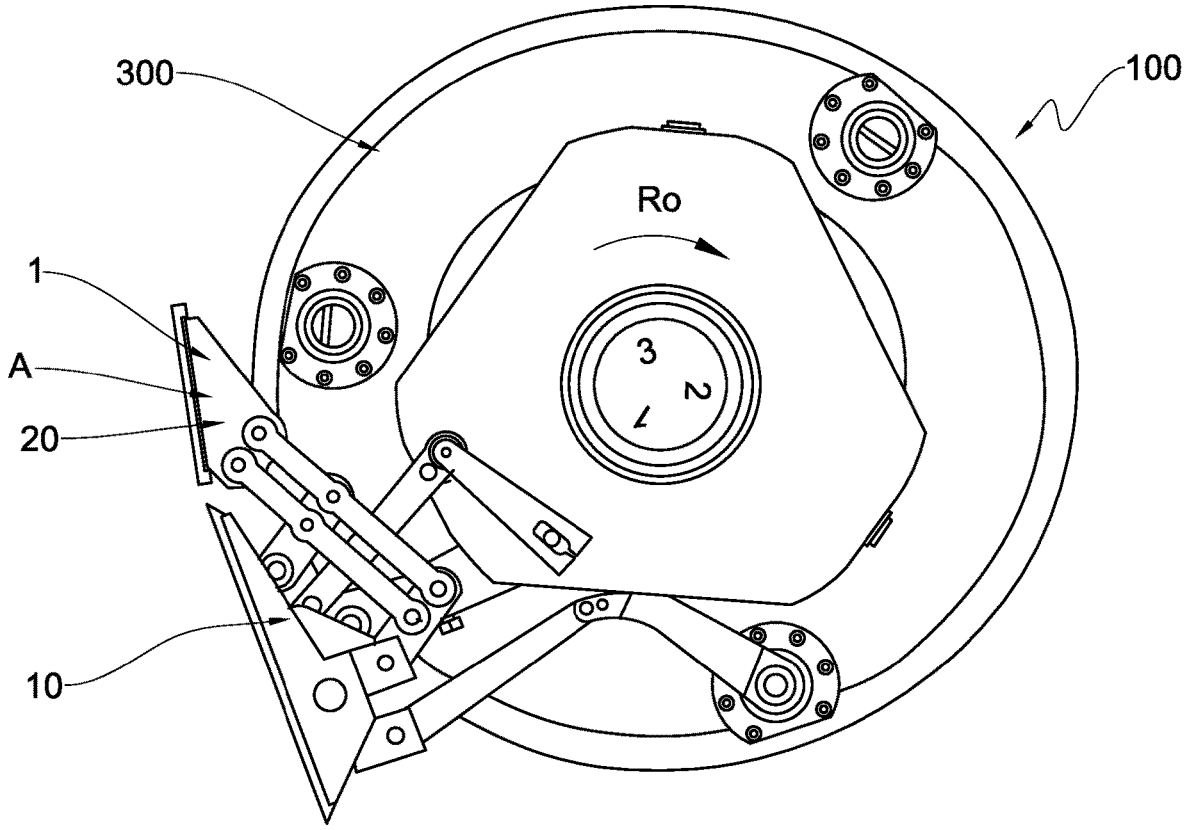

FIGS. 7 and 8*a* show a condition in which the second and third actuator 320, 330 are rotated in the opposite direction with respect to the rotation direction Ro of the drum 300 to thereby produce a stoppage of the retention device 1 and thus also of the retained blank 1. Such a stoppage may be useful to make the retention device 1 collaborate with a pre-folding unit (not shown in the figures) having rotating teeth which are capable of engaging on predefined surfaces of the blank and of rotating them in a desired direction.

As shown in FIG. 8*a*, the retention device 1 passes during this stoppage from the aligned configuration A to the rotated configuration R by means of the first actuator 310.

With reference to FIG. 8*b*, it can be noted that when the retention device 1 is in the rotated configuration R an angle of inclination θ1 between a line passing through the retention surface of the second retention elements 21*a* and a radial direction of the drum 300 forms an angle equal to approximately 60°.

This configuration ensures that the sail effect acting on the blank during the rotation of the drum is reduced and produces an increase in the constraints created by the retention elements on the blank.

It is interesting to note that this angle of inclination θ1 is determined by the movements produced by the rotation group 700: in fact, this value can also be varied depending, for example, on the configuration assumed by the cam type rotation mechanism 350.

Furthermore, with reference now to FIG. 9, it can be noted that the retention device 1 can change arrangement while the drum 300 rotates moving towards the aligned configuration A in which a second angle of inclination θ2 between the line passing through the retention surface of the second retention elements 21*a* and the radial direction of the drum 300 forms an angle of approximately 120°. In this case, the rotation of the second gripping portion 20 beyond 90° with respect to the radial direction of the drum is not given by the retention device 1 but by the specific configuration that the cam type rotation mechanism 350 assumes at that specific point of rotation of the drum 300. It is clear that this condition can be very favourably during a step of change with, for example, an additional retention unit.

Preferably, the pre-folding unit engages on the opposite side of the blank 200 with respect to the side retained by the retention device 1 in order to even more effectively guide the folding of the blank and simultaneously acts on further portions of the blank by also folding them about the virtual rotation axis V of the angle α.

FIG. 9 shows a release position of the movement unit 100 in which the retention device 1 can deactivate the retention elements 11*a*, 21*a* to release the blank 200 and allow it to be removed by an additional processing device.

The movement unit 100 may comprise a plurality of retention devices 1. In particular, and with reference to FIG. 10, it is noted that the movement unit 100 comprises three retention devices 1 which are arranged according to an axis of ternary symmetry passing through the rotation axis of the drum 300.

Again with reference to FIG. 10, an embodiment is shown in which the movement unit 100 comprises in addition to the drum 300 also a second drum 300', positioned near the drum 300, to which the blank 200 is transferred when the drum 300 is in the release position. The second drum 300' is entirely analogous to the drum 300, rotates in a synchronized manner but with an opposite direction to the drum 300 and, moreover, it also comprises three retention devices 1', entirely analogous to the retention devices 1 described above.

The passage of the blank 200 between the drum 300 and the second drum 300' takes place between a retention device 1 in a release position and a corresponding retention device 1' which is secured to the second drum 300' and which, in the rotation movement of the second drum 300', directly faces the retention device 1 on the opposite side to the blank 200.

Preferably, when the passage between the drum 300 and the second drum 300' takes place, a stoppage of both retention devices 1, 1' is carried out by means of respective cam type rotation mechanisms. During the stoppage, the retention elements 11*a*, 21*a* of both retention devices 1, 1' are kept active for a minimum time, generally under 1 second, in order to ensure a secure grip of the blank 200 by both retention devices involved, after which the retention elements of the retention device 1 are deactivated and only those of the retention device 1' which are secured to the second drum 300' are kept active.

As can be seen from the foregoing, the movement unit 100 is capable of continuously moving and processing the blanks 200 collected in a removal zone. In fact, as clearly illustrated in FIGS. 6 and 10, the drum 300 rotates continuously in a clockwise direction starting the removal process from the horizontal hopper 600 (shown in FIG. 10) which is positioned immediately upstream with respect to the movement unit 100. Here the retention device 1 assumes the aligned configuration A and activates the retention elements 11*a*, 21*a* to secure the blank to itself until the following release.

The drum 300 then rotates through approximately 150°-180° with respect to the removal position and reaches the pre-folding position (shown in FIGS. 7 and 8*a*). In this case, it can be noted that thanks to the second and third actuator 320, 330 it is also possible to carry out the stoppage of the retention device 1, while the drum 300 continues its continuous movement, in order to provide a longer time for the pre-folding process.

Subsequently, when the drum 300 in continuous movement makes a rotation through approximately 270° with respect to the removal position of the blank 200, the release position (shown in FIG. 9) is reached in which once again a stoppage of the retention device 1 is carried out by means of the aforesaid second and third actuators 320, 330, the aligned configuration A of the retention device 1 is taken and the retention elements 11*a*, 21*a* acting on the blank are deactivated.

Finally, the drum 300 accomplishes its 360° rotation and the retention device 1 is returned to the ideal configuration for removing a next blank.

It is interesting to note that it is possible to pass from the aligned configuration A to the rotated configuration R at any time of the rotation performed by the drum 300 and that, thanks to the possibility of selectively and independently activating the first actuator 310 with respect to the second and third actuator 320, 330, it is also possible to carry out a stoppage of the retention device 1 at any time of the rotation independently of the configuration in which the retention device 1 is located.

Thanks to these technical solutions, the Applicant has found that he can move at least 50 up to even 200 blanks per minute, depending on the size, overall dimensions and production requirements, with a single line movement unit.

The invention claimed is:

1. A movement unit for moving a blank, comprising:

i) at least one drum configured to rotate about a rotation axis along a rotation direction;

ii) a blank comprising:

a central panel, and a lateral panel having a first end secured to said central panel by a first folding zone, and a second, free, end opposite to said first end, said lateral panel extending for at least 10 cm in a direction perpendicular to said first folding zone and being configured to precede said central panel in said rotation direction of said at least one drum; and iii) at least one retention device for retaining said blank, the at least one retention device being secured to said at least one drum and comprising:

a support, a first gripping portion secured to said support and comprising first retention elements configured to selectively and fixedly retain said central panel, a second gripping portion secured to said support or to said first gripping portion, the second gripping portion comprising second retention elements configured to selectively and fixedly retain said lateral panel of said blank, and a movement mechanism for moving said second gripping portion with respect to said first gripping portion, said movement mechanism being configured to perform, during a rotational arc of said at least one drum, a controlled rotation of said second gripping portion with respect to said first gripping portion.

2. The movement unit according to claim 1, further comprising a rotation group configured to perform a controlled rotation of at least one of said first gripping portion and second gripping portion of said at least one retention device with respect to a radial direction of said at least one drum.

3. The movement unit according to claim 1, wherein said controlled rotation of said second gripping portion with respect to said first gripping portion is performed in a region proximal to said first folding zone of said blank.

4. The movement unit according to claim 1, wherein said first folding zone coincides with a creased portion of said blank.

5. The movement unit according to claim 1, further comprising a movement device configured to simultaneously move in translation said first gripping portion and said second gripping portion with respect to said support or with respect to another predetermined reference.

6. The movement unit according to claim 1, further comprising a cam type rotation mechanism configured to vary an angular rotation speed of said at least one retention device with respect to said at least one drum.

7. The movement unit according to claim 1, wherein said first and second retention elements are selectively connectable to a pressure reduction circuit.

8. The movement unit according to claim 1, further comprising a pre-folding device configured to cooperate with said at least one retention device in order to fold predetermined portions of said blank.

9. The movement unit according to claim 1, wherein the at least one retention device comprises a plurality of retention devices.

10. The movement unit according to claim 1, comprising a plurality of the at least one drum, each secured to a respective retention device of a plurality of retention devices, said plurality of retention devices being configured to exchange said blank between retention devices secured to different drums.

11. A packing apparatus for packing articles, comprising at least one movement unit according to claim 1.

12. The packing apparatus according to claim 11, comprising:

a first movement unit having a corresponding first retention device, and a second movement unit having a corresponding second retention device configured to receive said blank from the first retention device.

13. A process for moving a blank, comprising:

providing a movement unit comprising at least one drum having a rotation axis for rotating in a rotation direction, and at least one retention device secured to the at least one drum;

providing a blank comprising a central panel and a lateral panel, the lateral panel having a first end secured to said central panel by a first folding zone and a second, free, end opposite said first end, said lateral panel extending for at least 10 cm in a direction perpendicular to said first folding zone and being configured to precede said central panel in said rotation direction of said at least one drum;

bringing said at least one drum into a removal position, wherein said retention device faces said blank;

activating a first retention element of a first gripping portion of said retention device by selectively and fixedly securing said central panel to said first retention element;

activating a second retention element of a second gripping portion of said retention device by selectively and fixedly securing said lateral panel to said second retention element, thereby providing a controlled configuration of said blank;

rotating said at least one drum in a rotation direction up to a release position of said retention device, while controlling by said first and second retention elements respective positions and orientations of said central panel and said lateral panel;

rotating, in a controlled manner, at least one among said first gripping portion and said second gripping portion while said at least one drum rotates between said removal position and said release position, to provide a rotation equal to an angle of inclination between 60° and 120° with respect to a radial direction of said at least one drum; and deactivating said retention elements by disengaging said blank from said retention device while said at least one drum is in said release position.

14. The process according to claim 13, further comprising:

activating a movement device configured to move said blank in a direction having a radial component with respect to said rotation axis of said at least one drum.

15. The process according to claim 13, further comprising:

activating a cam type rotation mechanism included in said movement unit to stop said blank.

16. The process according to any one of claim 13, further comprising folding said blank by a pre-folding device while said at least one drum rotates from the removal position to the release position.

17. The process according to claim 13, further comprising:

rotating a first drum of said movement unit retaining said blank towards said release position;

rotating a second drum of said movement unit in a synchronized manner with said first drum and with a rotation direction opposite to a rotation direction of said first drum;

facing a first gripping portion of a first retention device secured to said first drum with a first gripping portion of a second retention device secured to said second drum;

facing a second gripping portion of the first retention device secured to said first drum with a second gripping portion of the second retention device secured to said second drum;

activating the retention elements of said first retention device and of said second retention device;

deactivating the retention elements of said first retention device while keeping active the retention elements of said second retention device;

performing, by said second retention device, said rotating towards a release position and a pure rotation of a first gripping portion with respect to a second gripping portion about a virtual rotation axis.

18. The process according to claim 13, further comprising activating an additional movement unit comprising an additional first retention element configured to remove said blank from said movement unit when said movement unit has completed said release.

* * * * *